US010796686B2

(12) United States Patent
Arik et al.

(10) Patent No.: US 10,796,686 B2
(45) Date of Patent: Oct. 6, 2020

(54) SYSTEMS AND METHODS FOR NEURAL TEXT-TO-SPEECH USING CONVOLUTIONAL SEQUENCE LEARNING

(71) Applicant: Baidu USA, LLC, Sunnyvale, CA (US)

(72) Inventors: Sercan O. Arik, San Francisco, CA (US); Wei Ping, Sunnyvale, CA (US); Kainan Peng, Sunnyvale, CA (US); Sharan Narang, Sunnyvale, CA (US); Ajay Kannan, San Francisco, CA (US); Andrew Gibiansky, Mountain View, CA (US); Jonathan Raiman, Palo Alto, CA (US); John Miller, Berkeley, CA (US)

(73) Assignee: Baidu USA LLC, Sunnyvale, CA (US)

( * ) Notice: Subject to any disclaimer, the term of this patent is extended or adjusted under 35 U.S.C. 154(b) by 55 days.

(21) Appl. No.: 16/058,265

(22) Filed: Aug. 8, 2018

(65) Prior Publication Data

US 2019/0122651 A1 Apr. 25, 2019

Related U.S. Application Data

(60) Provisional application No. 62/574,382, filed on Oct. 19, 2017.

(51) Int. Cl.

| | |
|---|---|
| ***G10L 13/027*** | (2013.01) |
| ***G10L 13/08*** | (2013.01) |
| ***G10L 13/047*** | (2013.01) |

(52) U.S. Cl.

CPC ..... *G10L 13/027* (2013.01); *G10L 13/08* (2013.01); *G10L 13/047* (2013.01)

(58) Field of Classification Search

CPC ..... G10L 13/027; G10L 13/08

See application file for complete search history.

(56) References Cited

U.S. PATENT DOCUMENTS

| | | | |
|---|---|---|---|
| 5,970,453 | A | 10/1999 | Sharman |
| 6,078,885 | A | 6/2000 | Beutnagel |
| 8,898,062 | B2 | 11/2014 | Kato |
| 9,508,341 | B1 | 11/2016 | Parlikar |

(Continued)

OTHER PUBLICATIONS

2015 IEEE International Conference, 2015.(5 pgs).

(Continued)

*Primary Examiner* — Mohammad K Islam

(74) *Attorney, Agent, or Firm* — North Weber & Baugh LLP

(57) ABSTRACT

Described herein are embodiments of a fully-convolutional attention-based neural text-to-speech (TTS) system, which various embodiments may generally be referred to as Deep Voice 3. Embodiments of Deep Voice 3 match state-of-the-art neural speech synthesis systems in naturalness while training ten times faster. Deep Voice 3 embodiments were scaled to data set sizes unprecedented for TTS, training on more than eight hundred hours of audio from over two thousand speakers. In addition, common error modes of attention-based speech synthesis networks were identified and mitigated, and several different waveform synthesis methods were compared. Also presented are embodiments that describe how to scale inference to ten million queries per day on one single-GPU server.

20 Claims, 12 Drawing Sheets

(56) References Cited

U.S. PATENT DOCUMENTS

| | | | | |
|---|---|---|---|---|
| 10,134,388 | B1 | 11/2018 | Lilly | |
| 10,319,364 | B2 * | 6/2019 | Reber | G06N 3/08 |
| 2001/0012999 | A1 | 8/2001 | Vitale | |
| 2002/0026315 | A1 | 2/2002 | Miranda | |
| 2003/0212555 | A1 | 11/2003 | van Santen | |
| 2004/0039570 | A1 | 2/2004 | Harengel | |
| 2004/0193398 | A1 | 9/2004 | Chu | |
| 2005/0033575 | A1 | 2/2005 | Schneider | |
| 2005/0119890 | A1 | 6/2005 | Hirose | |
| 2005/0137870 | A1 | 6/2005 | Mizutani | |
| 2005/0182629 | A1 | 8/2005 | Coorman | |
| 2005/0192807 | A1 | 9/2005 | Emam | |
| 2006/0149543 | A1 | 7/2006 | Lassalle | |
| 2007/0005337 | A1 | 1/2007 | Mount | |
| 2007/0094030 | A1 | 4/2007 | Xu | |
| 2007/0118377 | A1 | 5/2007 | Badino | |
| 2007/0168189 | A1 | 7/2007 | Tamura | |
| 2008/0114598 | A1 | 5/2008 | Prieto | |
| 2008/0167862 | A1 | 7/2008 | Mohajer | |
| 2009/0157383 | A1 | 6/2009 | Cho | |
| 2010/0004934 | A1 | 1/2010 | Hirose | |
| 2010/0312562 | A1 | 12/2010 | Wang | |
| 2011/0087488 | A1 | 4/2011 | Morinaka | |
| 2011/0202355 | A1 | 8/2011 | Grill | |
| 2012/0035933 | A1 | 2/2012 | Con Kie | |
| 2012/0143611 | A1 | 6/2012 | Qian | |
| 2012/0265533 | A1 | 10/2012 | Honeycutt | |
| 2013/0325477 | A1 | 12/2013 | Mitsui | |
| 2014/0046662 | A1 | 2/2014 | Tyagi | |
| 2015/0243275 | A1 | 8/2015 | Luan | |
| 2015/0279358 | A1 | 10/2015 | Kingsbury | |
| 2016/0078859 | A1 | 3/2016 | Luan | |
| 2017/0148433 | A1 | 5/2017 | Catanzaro | |

OTHER PUBLICATIONS

Ribeiro et al.,"Crowdmos: An approach for crowdsourcing mean opinion score studies," In Acoustics, Speech & Signal Processing (ICASSP) IEEE Intr Conference, 2011. (4 pgs).

Ronanki et al.,"A template-based approach for speech synthesis intonation generation using LSTMs," Interspeech 2016, pp. 2463-2467, 2016. (5pgs).

Sotelo et al.,"Char2wav: End-to-End speech synthesis," Retrieved from Internet <URL:<https://openreview.net/pdf?id.B1VWyySKx>, 2017. (6pgs).

Stephenson et al.,"Production Rendering, Design and Implementation," Springer, 2005. (5pgs).

Taylor et al.,"Text-to-Speech Synthesis," Cambridge University Press, New York, NY, USA, 1st edition, 2009. ISBN 0521899273, 9780521899277. (17 pgs).

Theis et al.,"A note on the evaluation of generative models," arXiv preprint arXiv:1511.01844, 2015. (9 pgs).

Oord et al.,"Wavenet: A generative model for raw audio," arXiv preprint arXiv:1609.03499, 2016. (15 pgs).

Weide et al.,"The CMU pronunciation dictionary," Retrieved from Internet <URL: <http://www.speech.cs.cmu.edu/cgi-bin/cmudict>, 2008. (2pgs).

Yao et al.,"Sequence-to-sequence neural net models for grapheme-to-phoneme conversion," arXiv preprint arXiv:1506.00196, 2015. (5 pgs).

Ribeiro et al.,"Crowdmos: An approach for crowdsourcing mean opinion score studies," In IEEE ICASSP, 2011. (4 pgs).

Rush et al.,"A neural attention model for abstractive sentence summarization," In EMNLP, 2015. (11 pgs).

Salimans et al.,"Weight normalization: A simple reparameterization to accelerate training of deep neural networks," In NIPS, arXiv:1602.07868v3, 2016. (11 pgs).

Sotelo et al.,"Char2wav: End-to-end speech synthesis," in ICLR workshop, 2017. (6 pgs).

Sutskever et al., "Sequence to Sequence Learning with Neural Networks", In NIPS, 2014. (9 pgs).

Taigman et al., "Voiceloop: Voicefitting Andsynthesis Via Aphonologicalloop", arXiv preprint arXiv:1707.06588, 2017. (12pgs).

Paul Taylor,"Text-to-Speech Synthesis,"[online], [Retrieved Aug. 1, 2019]. Retrieved from Internet <URL. <http://citeseerx.ist.psu.edu/viewdoc/download?doi=10.1.1.118.5905&rep=rep1&type=pdf> Cambridge University Press, 2009 (22 pgs).

Vaswani et al., "Attention Is All You Need", arXiv preprint arXiv:1706.03762, 2017.(15 pgs).

Wang et al.,"Tacotron:Towards End-to-End speech synthesis", In Interspeech, 2017.(5 pgs).

Yamagishi et al., "Robust Speaker-Adaptive HMM-Based Text-to-Speech Synthesis," In IEEE Transactions on Audio, and Language Processing, 2009. (23pgs).

Yamagishi et al., "Thousands of Voices for HMM-Based Speech Synthesis-Analysis and Application of TTS Systems Built on Various ASR Corpora", In IEEE Transactions on Audio, Speech, and Language Processing, 2010. (21 pgs).

Yamagishi et al.,"Robust Speaker-Adaptive HMM-Based Text-to-Speech Synthesis," IEEE Transactions on Audio, Speech, and Language Processing, vol. 17, No. 6, Aug. 2009, [online], [Retrieved Jul. 8, 2018]. Retrieved from Internet <URL: <https://www.researchgate.net/publication/224558048> (24 pgs).

Abadi et al.,"TensorFlow: Large-scale machine learning on heterogeneous systems," Retrieved from Internet <URL: http://download.tensorflow.org/paper/whitepaper2015.pdf>, 2015. (19pgs).

Amodei et al.,"Deep speech 2: End-to-End speech recognition in English and Mandarin," arXiv preprint arXiv:1512.02595, 2015. (28pgs).

Boersma et al.,"PRAAT, a system for doing phonetics by computer," Glot international, vol. 5, No. 9/10, Nov./Dec. 2001 (341-347). (7pgs).

Bradbury et al.,"Quasi-recurrent neural networks," arXiv preprint arXiv:1611.01576, 2016. (11pgs).

Chung et al.,"Empirical evaluation of gated recurrent neural networks on sequence modeling," arXiv preprint arXiv:1412.3555, 2014. (9 pgs).

Diamos et al.,"Persistent RNNS: Stashing recurrent weights On-Chip," In Proceedings of The 33rd International Conference on Machine Learning, 2016. (10pgs).

Dukhan et al.,"PeachPy meets Opcodes: direct machine code generation from Python," In Proceedings of the 5th Workshop on Python for High-Performance and Scientific Computing, 2015. (2 pgs).

Graves et al.,"Connectionist temporal classification:Labelling unsegmented sequence data with recurrent neural networks," In Proceedings of the 23rd International Conference.

P. Taylor,"Text-to-Speech Synthesis," Cambridge University Press, 2009. [online], [Retrieved Sep. 3, 2019]. Retrieved from Internet <URL: <http://citeseerx.ist.psu.edu/viewdoc/download?doi=10.1.1.118.5905&rep=rep1&type=pdf>. (19 pgs).

Uria et al.,"RNADE: The real-valued neural autoregressive density-estimator," In Advances in Neural Information Processing Systems, pp. 2175-2183, 2013. (10pgs).

A.van den Oord et al.,"WaveNet: A generative model for raw audio," arXiv preprint arXiv:1609.03499, 2016. (15pgs).

A.van den Oord et al.,"Conditional image generation with PixelCNN decoders," In NIPS, 2016. (9pgs).

A.van den Oord et al.,"Parallel WaveNet: Fast high-fidelity speech synthesis," In ICML, 2018. (9pgs).

R. Yamamoto,"WaveNet vocoder," 2018 [online], [Retrieved Sep. 4, 2019]. Retrieved from Internet <URL: <https://github.com/r9y9/wavenet_vocoder>. (6pgs).

Zhao et al.,"Wasserstein GAN & Waveform Loss-based acoustic model training for multi-speaker text-to-speech synthesis systems using a WaveNet vocoder,"IEEE Access,2018.(10pgs).

Response filed Nov. 26, 2019, in U.S. Appl. No. 15/882,926 (11 pgs).

Kaiser et al.,"Fast decoding in sequence models using discrete latent variables," arXiv preprint arXiv:1803.03382, 2018. (10pgs).

Kim et al.,"Sequence-level knowledge distillation," In EMNLP, 2016. (11pgs).

Kingma et al.,"ADAM: A method for stochastic optimization," In ICLR, 2015. (15 pgs).

(56) References Cited

OTHER PUBLICATIONS

Kingma et al.,"Auto-Encoding variational Bayes," In ICLR, 2014. (14 pgs).
Kingma et al.,"Improving variational inference with inverse autoregressive flow," In NIPS, 2016. (9 pgs).
Lee et al.,"Deterministic non-autoregressive neural sequence modeling by iterative refinement," arXiv preprint arXiv:1802.06901, 2018. (11 pgs).
Mehri et al.,"SampleRNN:An unconditional end-to-end neural audio generation model," In ICLR, 2017. (11pgs).
Morise et al.,"WORLD: a vocoder-based high-quality speech synthesis system for real-time applications," IEICE Transactions on Information & Systems, 2016. (8 pgs).
K. Murphy,"Machine learning, A probabilistic perspective," 2012, [online], [Retrieved Sep. 3, 2019]. Retrieved from Internet <URL: <https://doc.lagout.org/science/Artificial%20Intelligence/Machine%20Learning/Machine%20Learning_%20A%20Probabilistic%20Perspective%20%5BMurphy%202012-08-24%5D.pdf> (24 pgs).
On Machine Learning, ICML, USA, 2006. (8 pgs).
Kingma et al.,"Adam: A method for stochastic optimization," arXiv preprint arXiv:1412.6980, 2014. (9 pgs).
Mehri et al.,"SampleRNN: An unconditional end-to-end neural audio generation model," arXiv preprint arXiv:1612.07837, 2016. (11pgs).
Morise et al.,"WORLD: a vocoder-based high-quality speech synthesis system for real-time applications,"IEICE Transactions on Information and Systems, 2016. (8 pgs).
Oord et al.,"Pixel recurrent neural networks," arXiv preprint arXiv:1601.06759, 2016. (10 pgs).
Paine et al.,"Fast wavenet generation algorithm," arXiv preprint arXiv:1611.09482, 2016. (6 pgs).
Pascual et al.,"Multi-output RNN-LSTM for multiple speaker speech synthesis with interpolation model," 9th ISCA Speech Synthesis Workshop, 2016. (6 pgs).
Prahallad et al.,"The blizzard challenge 2013-Indian language task," Retrieved from Internet <URL: <http://festvox.org/blizzard/bc2013/blizzard_2013_summary_indian.pdf>, 2013. ( 11pgs).
Rao et al.,"Grapheme-to-phoneme conversion using long short-term memory recurrent neural networks," In Acoustics, Speech and Signal Processing (ICASSP).
Wu et al.,"A study of speaker adaptation for DNN-based speech synthesis," In Interspeech, 2015. (5 pgs).
Yamagishi et al.,"Robust speaker-adaptive HMM-based text-to-speech synthesis," IEEE Transactions on Audio, Speech, and Language Processing, 2009. (23 pgs).
Yang et al.,"On the training of DNN-based average voice model for speech synthesis," In Signal & Info. Processing Association Annual Summit & Conference (APSIPA), Retrieved from Internet <URL: <http://www.nwpu-aslp.org/lxie/papers/2016APSIPA-YS.pdf>, 2016. (6 pgs).
Zen et al.,"Unidirectional long short-term memory recurrent neural network with recurrent output layer for low-latency speech synthesis," In IEEE ICASSP, 2015. (5 pgs).
Zen et al.,"Fast, Compact, and High quality LSTM-RNN based statistical parametric speech synthesizers for mobile devices," arXiv:1606.06061, 2016. (14 pgs).
Gehring,"Convolutional sequence to sequence learing," In ICML, 2017. (10 pgs).
Ping et al.,"ClariNet: ParallelWave Generation in End-to-End Text-to-Speech," arXiv preprint arXiv:1807.07281, 2018. (12 pgs).
Divay et al., "Algorithms for Grapheme-Phoneme Translation for English and French: Applications for Database Searches and Speech Synthesis," Association for Computational Linguistics,1997. (29 pgs).
Non-Final Office Action dated Aug. 30, 2019, in U.S. Appl. No. 15/882,926 (10 pgs).
Abdel-Hamid et al.,"Fast speaker adaptation of hybrid NN/HMM model for speech recognition based on discriminative learning of speaker code," In ICASSP, 2013. (5pgs).
Arik et al.,"Deep Voice: Real-time neural text-to-speech," arXiv preprint arXiv:1702.07825, 2017. (17 pgs).
Bradbury et al.,"Quasi-Recurrent Neural Networks," In ICLR, 2017. (12pgs).
Cho et al.,"Learning Phrase Representations using RNN Encoder-Decoder for statistical machine translation," arXiv:1406.1078, 2014. (14 pgs).
Fan et al.,"Multi-speaker modeling and speaker adaptation for DNN-based TTS synthesis," In IEEE ICASSP, 2015. (2 pgs).
Graves et al.,"Connectionist temporal classification: labelling unsegmented sequence data with recurrent neural networks,".
In Proceedings of the 23rd International Conference on Machine Learning (ICML), 2006. (8 pgs).
Hsu et al.,"Voice conversion from unaligned corpora using variational autoencoding wasserstein generative adversarial networks," arXiv:1704.00849, 2017. (5 pgs).
Ioffe et al.,"Batch normalization: Accelerating deep network training by reducing internal covariate shift," arXiv preprint arXiv:1502.03167, 2015. (10 pgs).
Y. Agiomyrgiannakis,"Vocaine the vocoder and applications in speech synthesis," In ICASSP, 2015. (5 pgs).
Arik et al.,"Deep Voice: Real-time neural text-to-speech," arXiv preprint aeXiv:1702.07825v2, 2017. (17 pgs).
Arik et al.,"Deep Voice 2: Multi-speaker neural text-to-speech," arXiv preprint arXiv:1705.08947v1, 2017. (15 pgs).
C. Bagwell,"SoX—Sound eXchange," [online], [Retrieved Jul. 22, 2019]. Retrieved from Internet <URL:https://sourceforge.net/p/sox/code/ci/master/tree/> (3 pgs).
Bandanau et al.,"Neural machine translation by jointly learning to align and translate," arXiv preprint arXiv:1409.0473v1, 2014. (15pgs).
Capes et al.,"Siri On-Device Deep Learning-Guided Unit Selection Text-to-Speech System," In Interspeech, 2017. (5pgs).
Cho et al.,"Learning phrase representations using RNN encoder-decoder for statistical machine translation," In EMNLP, 2014. (11pgs).
Chorowski et al., "Attention-based models for speech recognition," In NIPS, 2015. (9pgs).
Dauphin et al.,"Language modeling with gated convolutional networks," arXiv preprint arXiv:1612.08083v1, 2016. (8pgs).
Gehring et al.,"Convolutional sequence to sequence learning," arXiv preprint arXiv:1705.03122v1, 2017. (15 pgs).
Arik et al.,"Deep Voice: Real-time neural text-to-speech," In ICML, 2017. (17pgs).
Arik et al.,"Deep Voice 2: Multi-speaker neural text-to-speech," In NIPS, 2017. (15 pgs).
Bandanau et al.,"Neural machine translation by jointly learning to align and translate,"In ICLR, 2015. (15 pgs).
Bucilua et al.,"Model Compression," In ACM SIGKDD, 2006. (7 pgs).
Chung et al.,"A recurrent latent variable model for sequential data," In NIPS, 2015. (9pgs).
Dinh et al.,"NICE: Non-linear independent components estimation," arXiv preprint arXiv:1410.8516, 2015. (13 pgs).
Dinh et al.,"Density estimation using Real NVP," In ICLR, 2017. (32pgs).
Griffin et al.,"Signal estimation from modified short-time Fourier transform," IEEE Transactions on Acoustics, Speech, and Signal Processing, 1984. (8pgs).
Gu et al.,"Non-autoregressive neural machine translation," In ICLR, 2018. (13 pgs).
Hinton et al.,"Distilling the knowledge in a neural network," arXiv preprint arXiv:1503.02531, 2015. (9 pgs).
Non-Final Office Action dated Feb. 7, 2020, in U.S. Appl. No. 15/974,397 (10 pgs).
Non-Final Office Action dated Feb. 3, 2020, in U.S. Appl. No. 15/882,926 (10 pgs).
Lample et al.,"Neural architectures for named entity recognition," arXiv preprint arXiv:1603.01360, 2016. (10 pgs).
Li et al.,"Deep speaker: an End-to-End neural speaker embedding system," arXiv preprint arXiv:1705.02304, 2017. (8 pgs).
Reynolds et al.,"Speaker verification using adapted gaussian mixture models," Digital signal processing, 10(1-3):19-41, 2000. (23 pgs).

(56) References Cited

OTHER PUBLICATIONS

Ronanki et al.,"Median-based generation of synthetic speech durations using a non-parametric approach," arXiv preprint arXiv:1608.06134, 2016. (7 pgs).
Salimans et al.,"Improved techniques for training GANs," In NIPS, 2016. (9 pgs).
Sotelo et al.,"CHAR2WAV: End-to-End speech synthesis," In ICLR2017 workshop submission, 2017. (6pgs).
Wang et al.,"Tacotron: Towards end-to-end speech synthesis," In Interspeech, 2017. (3 pgs).
Zen et al,"Unidirectional long short-term memory recurrent neural network with recurrent output layer for low-latency speech synthesis," Retrieved from Internet <URL: <https://static.googleusercontent.com/media/research.google.com/en//pubs/archive/43266.pdf>, 2015. (5pgs).
Zen et al.,"Statistical parametric speech synthesis using deep neural networks," Retrieved from Internet <URL: <https://static.googleusercontent.com/media/research.google.com/en//pubs/archive/40837.pdf>, 2013. (5pgs).
Gonzalvo et al.,"Recent advances in Google real-time HMM-driven unit selection synthesizer," In Interspeech, 2016. (5 pgs).
Kawahara et al.,"Restructuring speech representations using a pitch-adaptive time-Frequency smoothing and an instantaneous-frequency-based F0 extraction: Possible role of a repetitive structure in sounds," Speech communication, 1999. (21pgs).
Ochshorn et al., "Gentle," Retrieved from Internet <URL: https://github.com/lowerquality/gentle> 2017. (2 pgs).
Van den Oord et al.,"WaveNet: A generative model for raw audio," arXiv:1609.03499, 2016. (15 pgs).
Panayotov et al.,"Librispeech: an ASR corpus based on public domain audio books," In Acoustics, Speech and Signal Processing (ICASSP), 2015 IEEE. (5 pgs).
Raffel et al.,"Online and linear-time attention by enforcing monotonic alignments," arXiv:1704.00784v1, 2017. (19 pgs).
Odena et al.,"Deconvolution and checkerboard artifacts," 2016, [Retrieved Sep. 3, 2019]. Retrieved from Internet <URL:<https://distill.pub/2016/deconv-checkerboard/>.(10pgs).
Pascanu et al.,"On the difficulty of training recurrent neural networks," In ICML, 2013. (9pgs).
Ping et al.,"Deep Voice 3: Scaling text-to-speech with convolutional sequence learning," In ICLR, 2018. (16pgs).
Rezende et al.,"Variational inference with normalizing flows," In ICML, 2015. (10 pgs).
Ribeiro et al.,"CrowdMOS: An approach for crowdsourcing mean opinion score studies," In ICASSP, 2011. (4 pgs).
Roy et al,"Theory and experiments on vector quantized autoencoders," arXiv preprint arXiv:1805.11063, 2018. (11pgs).
Salimans et al.,"PixelCNN++: Improving the PixelCNN with discretized logistic mixture likelihood and other modifications," In ICLR, 2017. (10pgs).
Shen et al.,"Natural TTS synthesis by conditioning WaveNet on mel spectrogram predictions," In ICASSP, 2018. (5pgs).
Sotelo et al.,"Char2wav:End-to-end speech synthesis," ICLR workshop, 2017. (6pgs).
Taigman et al.,"VoiceLoop: Voice fitting and synthesis via a phonological loop," In ICLR, 2018.(14 pgs).
Arik et al.,"Neural voice cloning with a few samples," arXiv preprint arXiv:1802.06006, 2018. (18pgs).
Bengio et al.,"Scheduled sampling for sequence prediction with recurrent neural networks," arXiv preprint arXiv:1506.03099, 2015. (9pgs).
Bowman et al.,"Generating sentences from a continuous space," in Proceedings of the 20th Signll Conference on Computational Natural Language Learning, 2016. (12pgs).
Denton et al.,"Stochastic video generation with a learned prior,"arXiv preprint arXiv:1802.07687, 2018. (12pgs).
Jia et al.,"Transfer learning from speaker verification to multispeaker text-to-speech synthesis," arXiv preprint arXiv:1806.04558, 2019. (15pgs).
Kalchbrenner et al.,"Efficient neural audio synthesis," arXiv preprint arXiv:1802.08435, 2018. (10pgs).
Kingma et al.,"Glow: Generative flow with invertible 1x1 convolutions," arXiv preprint arXiv:1807.03039, 2018. (15pgs).
Nachmani et al.,"Fitting new speakers based on a short untranscribed sample," arXiv preprint arXiv:1802.06984, 2018. (9pgs).
Rezende et al.,"Stochastic backpropagation and approximate inference in deep generative models," arXiv preprint arXiv:1401.4082, 2014. (14pgs).
van den Oord et al.,"Neural discrete representation learning," arXiv preprint arXiv:1711.00937, 2018. (11pgs).
Final Office Ation dated Jun. 15, 2020, in related U.S. Appl. No. 15/882,926 (10 pgs).
Final Office Ation dated Jun. 24, 2020, in related U.S. Appl. No. 15/974,397 (11 pgs).
Notice of Allowance and Fee Due dated Aug. 11, 2020, in related U.S. Appl. No. 16/277,919 (10 pgs).
Notice of Allowance and Fee Due dated Aug. 26, 2020, in related U.S. Appl. No. 15/822,926.
Response filed Aug. 23, 2020, in U.S. Appl. No. 15/974,397 (15 pgs).
Response filed Aug. 17, 2020, in U.S. Appl. No. 15/882,926 (10 pgs).

* cited by examiner

300

400

500A

500B

500C

600

800A

800B

SYSTEMS AND METHODS FOR NEURAL TEXT-TO-SPEECH USING CONVOLUTIONAL SEQUENCE LEARNING

CROSS-REFERENCE TO RELATED APPLICATION

This application claims the priority benefit under 35 USC § 119(e) to U.S. Provisional Patent Application No. 62/574,382, filed on 19 Oct. 2017, entitled "SYSTEMS AND METHODS FOR NEURAL TEXT-TO-SPEECH USING CONVOLUTIONAL SEQUENCE LEARNING," and listing Sercan Ö. Arik, Wei Ping, Kainan Peng, Sharan Narang, Ajay Kannan, Andrew Gibiansky, Jonathan Raiman, and John Miller as inventors. The aforementioned patent document is incorporated by reference herein in its entirety.

BACKGROUND

A. Technical Field

The present disclosure relates generally to systems and methods for computer learning that can provide improved computer performance, features, and uses. More particularly, the present disclosure relates to systems and methods for text-to-speech through deep neutral networks.

B. Background

Artificial speech synthesis systems, commonly known as text-to-speech (TTS) systems, convert written language into human speech. TTS systems are used in a variety of applications, such as human-technology interfaces, accessibility for the visually-impaired, media, and entertainment. Fundamentally, it allows human-technology interaction without requiring visual interfaces. Traditional TTS systems are based on complex multi-stage hand-engineered pipelines. Typically, these systems first transform text into a compact audio representation, and then convert this representation into audio using an audio waveform synthesis method called a vocoder Due to its complexity, developing TTS systems can be very labor intensive and difficult. Recent work on neural TTS has demonstrated impressive results, yielding pipelines with somewhat simpler features, fewer components, and higher quality synthesized speech. There is not yet a consensus on the optimal neural network architecture for TTS.

Accordingly, what is needed are systems and methods for creating, developing, and/or deploying improved speaker text-to-speech systems.

BRIEF DESCRIPTION OF THE DRAWINGS

References will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments. Items in the figures are not to scale.

Figure ("FIG.") 1 graphical depicts an example text-to-speech architecture, according to embodiments of the present disclosure.

DETAILED DESCRIPTION OF EMBODIMENTS

Figure 1:
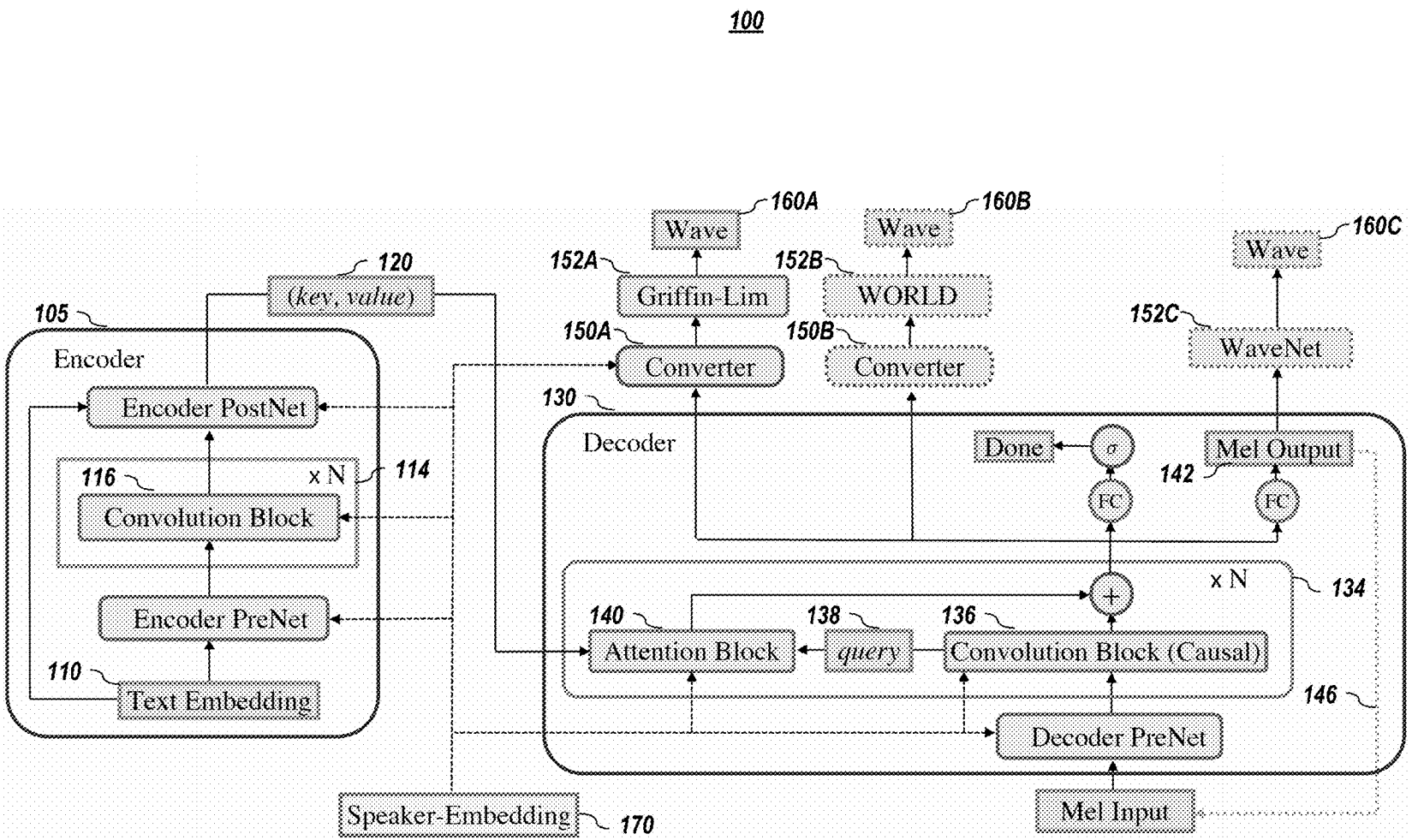

In the following description, for purposes of explanation, specific details are set forth in order to provide an understanding of the invention. It will be apparent, however, to one skilled in the art that the invention can be practiced without these details. Furthermore, one skilled in the art will recognize that embodiments of the present invention, described below, may be implemented in a variety of ways, such as a process, an apparatus, a system, a device, or a method on a tangible computer-readable medium.

Components, or modules, shown in diagrams are illustrative of exemplary embodiments of the invention and are meant to avoid obscuring the invention. It shall also be understood that throughout this discussion that components may be described as separate functional units, which may comprise sub-units, but those skilled in the art will recognize that various components, or portions thereof, may be divided into separate components or may be integrated together, including integrated within a single system or component. It should be noted that functions or operations discussed herein may be implemented as components. Components may be implemented in software, hardware, or a combination thereof.

Furthermore, connections between components or systems within the figures are not intended to be limited to direct connections. Rather, data between these components may be modified, re-formatted, or otherwise changed by intermediary components. Also, additional or fewer connections may be used. It shall also be noted that the terms "coupled," "connected," or "communicatively coupled" shall be understood to include direct connections, indirect connections through one or more intermediary devices, and wireless connections.

Reference in the specification to "one embodiment," "preferred embodiment," "an embodiment," or "embodiments" means that a particular feature, structure, characteristic, or function described in connection with the embodiment is included in at least one embodiment of the invention and may be in more than one embodiment. Also, the appearances of the above-noted phrases in various places in the specification are not necessarily all referring to the same embodiment or embodiments.

The use of certain terms in various places in the specification is for illustration and should not be construed as limiting. A service, function, or resource is not limited to a single service, function, or resource; usage of these terms may refer to a grouping of related services, functions, or resources, which may be distributed or aggregated.

The terms "include," "including," "comprise," and "comprising" shall be understood to be open terms and any lists the follow are examples and not meant to be limited to the listed items. Any headings used herein are for organizational purposes only and shall not be used to limit the scope of the description or the claims. Each reference mentioned in this patent document is incorporate by reference herein in its entirety.

Furthermore, one skilled in the art shall recognize that: (1) certain steps may optionally be performed; (2) steps may not be limited to the specific order set forth herein; (3) certain steps may be performed in different orders; and (4) certain steps may be done concurrently.

A. INTRODUCTION

Presented herein are novel fully-convolutional architecture embodiments for speech synthesis. Embodiments were scaled to very large audio data sets, and several real-world issues that arise when attempting to deploy an attention-based TTS system are addressed herein. Some of the contributions provided by embodiment disclosed herein include but are not limited to:

1. Fully-convolutional character-to-spectrogram architecture embodiments, which enable fully paralleled computation and are trained an order of magnitude faster than analogous architectures using recurrent cells. Architecture embodiments may be generally referred to herein for convenience as Deep Voice 3 or DV3.

2. It is shown that architecture embodiments train quickly and scale to the LibriSpeech ASR dataset (Panayotov et al., 2015), which comprises nearly 820 hours of audio data from 2484 speakers.

3. It is demonstrated that monotonic attention behavior can be generated, avoiding error modes commonly affecting sequence-to-sequence models.

4. The quality of several waveform synthesis methods are compared, including WORLD (Morise et al., 2016), Griffin-Lim (Griffin & Lim, 1984), and WaveNet (Oord et al., 2016).

5. Implementation embodiments of an inference kernel for Deep Voice 3 are described, which can serve up to ten million queries per day on one single-GPU (graphics processing unit) server.

B. RELATED WORK

Embodiment herein advance the state-of-the-art in neural speech synthesis and attention-based sequence-to-sequence learning.

Several recent works tackle the problem of synthesizing speech with neural networks, including: Deep Voice 1 (which is disclosed in commonly-assigned U.S. patent application Ser. No. 15/882,926, filed on 29 Jan. 2018, entitled "SYSTEMS AND METHODS FOR REAL-TIME NEURAL TEXT-TO-SPEECH," and U.S. Prov. Pat. App. No. 62/463,482, filed on 24 Feb. 2017, entitled "SYSTEMS AND METHODS FOR REAL-TIME NEURAL TEXT-TO-SPEECH," each of the aforementioned patent documents is incorporated by reference herein in its entirety (which disclosures may be referred to, for convenience, as "Deep Voice 1" or "DV1"); Deep Voice 2 (which is disclosed in commonly-assigned U.S. patent application Ser. No. 15/974,397, filed on 8 May 2018, entitled "SYSTEMS AND METHODS FOR MULTI-SPEAKER NEURAL TEXT-TO-SPEECH," and U.S. Prov. Pat. App. No. 62/508,579, filed on 19 May 2017, entitled "SYSTEMS AND METHODS FOR MULTI-SPEAKER NEURAL TEXT-TO-SPEECH," each of the aforementioned patent documents is incorporated by reference herein in its entirety (which disclosures may be referred to, for convenience, as "Deep Voice 2" or "DV2"); Tacotron (Wang et al., 2017); Char2Wav (Sotelo et al., 2017); VoiceLoop (Taigman et al., 2017); SampleRNN (Mehri et al., 2017), and WaveNet (Oord et al., 2016).

At least some of the embodiments of Deep Voice 1 and 2 retain the traditional structure of TTS pipelines, separating grapheme-to-phoneme conversion, duration and frequency prediction, and waveform synthesis. In contrast to Deep Voice 1 and 2 embodiments, embodiments of Deep Voice 3 employ an attention-based sequence-to-sequence model, yielding a more compact architecture. Tacotron and Char2Wav are two proposed sequence-to-sequence models for neural TTS. Tacotron is a neural text-to-spectrogram conversion model, used with Griffin-Lim for spectrogram-to-waveform synthesis. Char2Wav predicts the parameters of the WORLD vocoder (Morise et al., 2016) and uses a SampleRNN conditioned upon WORLD parameters for waveform generation. In contrast to Char2Wav and Tacotron, embodiments of Deep Voice 3 avoid Recurrent Neural Networks (RNNs) to speed up training. RNNs introduce sequential dependencies that limit model parallelism during training. Thus, Deep Voice 3 embodiments make attention-based TTS feasible for a production TTS system with no compromise on accuracy by avoiding common attention errors. Finally, WaveNet and SampleRNN are proposed as neural vocoder models for waveform synthesis. There are also numerous alternatives for high-quality hand-engineered vocoders in the literature, such as STRAIGHT (Kawahara et al., 1999), Vocaine (Agiomyrgiannakis, 2015), and WORLD (Morise et al., 2016). Embodiments of Deep Voice 3 add no novel vocoder, but have the potential to be integrated with different waveform synthesis methods with slight modifications of its architecture.

Automatic speech recognition (ASR) datasets are often much larger than traditional TTS corpora but tend to be less clean, as they typically involve multiple microphones and background noise. Although prior work has applied TTS methods to ASR datasets, embodiments of Deep Voice 3 are, to the best of our knowledge, the first TTS system to scale to thousands of speakers with a single model.

Sequence-to-sequence models typically encode a variable-length input into hidden states, which are then processed by a decoder to produce a target sequence. An attention mechanism allows a decoder to adaptively select encoder hidden states to focus on while generating the target sequence. Attention-based sequence-to-sequence models are widely applied in machine translation, speech recognition, and text summarization. Recent improvements in attention mechanisms relevant to Deep Voice 3 include enforced-monotonic attention during training, fully-attentional non-recurrent architectures, and convolutional sequence-to-sequence models. Deep Voice 3 embodiments demonstrate the utility of monotonic attention during training in TTS, a new domain where monotonicity is expected. Alternatively, it is shown that with a simple heuristic to only enforce monotonicity during inference, a standard attention mechanism can work just as well or even better. Deep Voice 3 embodiments also build upon a convolutional sequence-to-sequence architecture by introducing a positional encoding augmented with a rate adjustment to account for the mismatch between input and output domain lengths.

C. MODEL ARCHITECTURE EMBODIMENTS

In this section, embodiment of a fully-convolutional sequence-to-sequence architecture for TTS are presented. Architecture embodiments are capable of converting a variety of textual features (e.g., characters, phonemes, stresses) into a variety of vocoder parameters, e.g., mel-band spectrograms, linear-scale log magnitude spectrograms, fundamental frequency, spectral envelope, and aperiodicity parameters. These vocoder parameters may be used as inputs for audio waveform synthesis models.

In one or more embodiments, a Deep Voice 3 architecture comprises three components:

- Encoder: A fully-convolutional encoder, which converts textual features to an internal learned representation.
- Decoder: A fully-convolutional causal decoder, which decodes the learned representation with a multi-hop convolutional attention mechanism into a low-dimensional audio representation (mel-band spectrograms) in an auto-regressive manner.
- Converter: A fully-convolutional post-processing network, which predicts final vocoder parameters (depending on the vocoder choice) from the decoder hidden states. Unlike the decoder, the converter is non-causal and can thus depend on future context information.

FIG. 1 graphical depicts an example Deep Voice 3 architecture 100, according to embodiments of the present disclosure. In embodiment, a Deep Voice 3 architecture 100 uses residual convolutional layers in an encoder 105 to encode text into per-timestep key and value vectors 120 for an attention-based decoder 130. In one or more embodiments, the decoder 130 uses these to predict the mel-scale log magnitude spectrograms 142 that correspond to the output audio. In FIG. 1, the dotted arrow 146 depicts the autoregressive synthesis process during inference (during training, mel-spectrogram frames from the ground truth audio corresponding to the input text are used). In one or more embodiments, the hidden states of the decoder 130 are then fed to a converter network 150 to predict the vocoder parameters for waveform synthesis to produce an output wave 160. Appendix 1, which includes FIG. 7 that graphically depicts an example detailed model architecture, according to embodiments of the present disclosure, provides additional details.

In one or more embodiments, the overall objective function to be optimized may be a linear combination of the losses from the decoder (Section C.5) and the converter (Section C.6). In one or more embodiments, the decoder 130 and converter 150 are separated and multi-task training is applied, because it makes attention learning easier in practice. To be specific, in one or more embodiments, the loss for mel-spectrogram prediction guides training of the attention mechanism, because the attention is trained with the gradients from mel-spectrogram prediction (e.g., using an L1 loss for the mel-spectrograms) besides vocoder parameter prediction.

In a multi-speaker scenario, trainable speaker embeddings 170 as in Deep Voice 2 embodiments are used across encoder 105, decoder 130, and converter 150.

Figure 2:
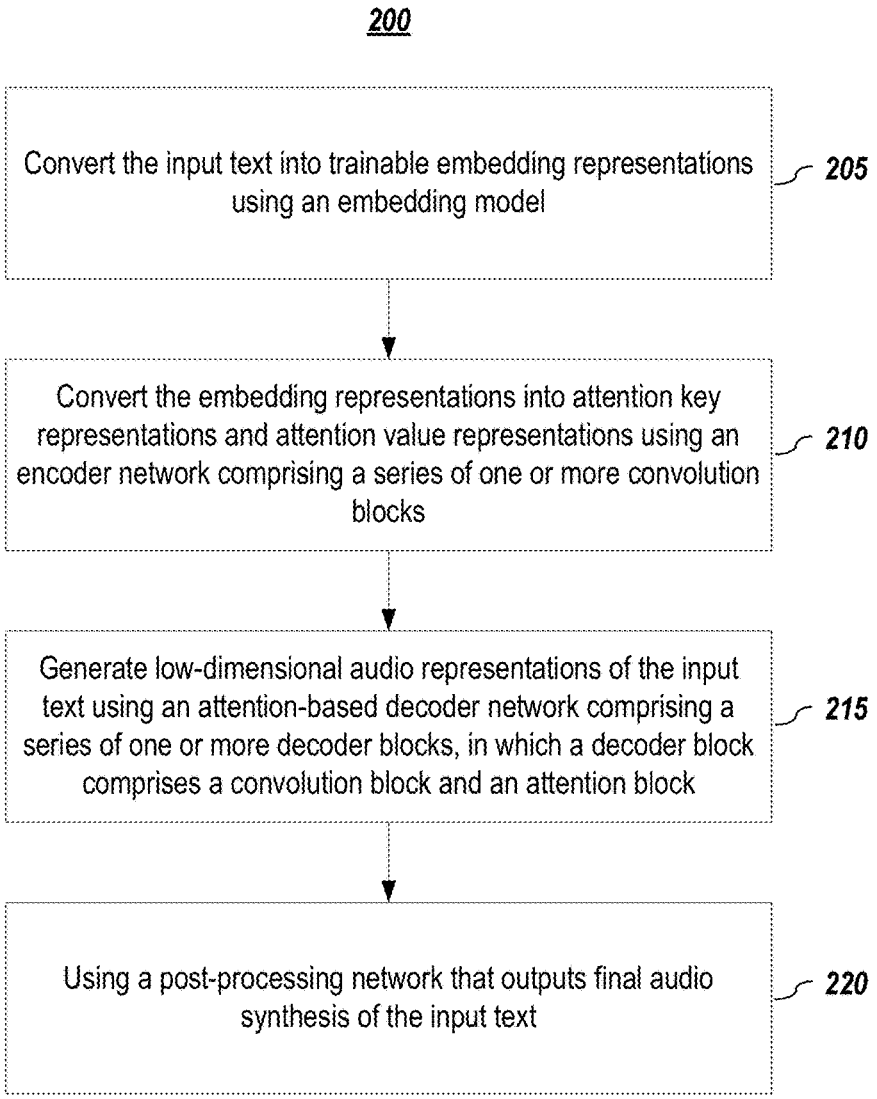
FIG. 2 depicts a general overall methodology for using a text-to-speech architecture, such as depicted in FIG. 1, according to embodiments of the present disclosure.
Figure 7:
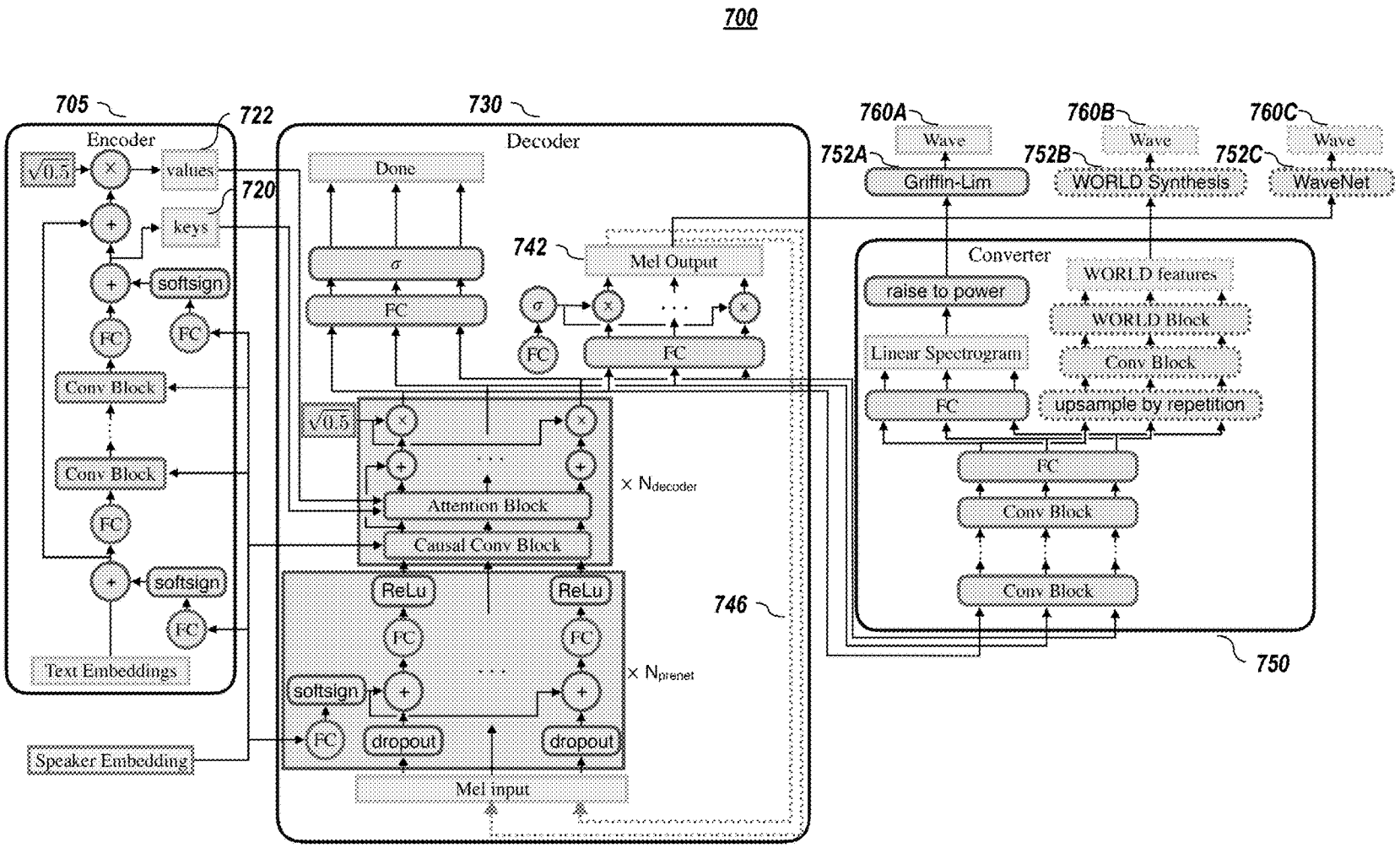
FIG. 7 graphically depicts an example detailed Deep Voice 3 model architecture, according to embodiments of the present disclosure.

FIG. 2 depicts a general overview methodology for using a text-to-speech architecture, such as depicted in FIG. 1 or FIG. 7, according to embodiments of the present disclosure. In one or more embodiments, an input text is converted (205) into trainable embedding representations using an embedding model, such as text embedding model 110. The embedding representations are converted (210) into attention key representations 120 and attention value representations 120 using an encoder network 105, which comprises a series 114 of one or more convolution blocks 116. These attention key representations 120 and attention value representations 120 are used by an attention-based decoder network, which comprises a series 134 of one or more decoder blocks 134, in which a decoder block 134 comprises a convolution block 136 that generates a query 138 and an attention block 140, to generate (215) low-dimensional audio representations (e.g., 142) of the input text. In one or more embodiments, the low-dimensional audio representations of the input text may undergo additional processing by a post-processing network (e.g., 150A/152A, 150B/152B, or 152C) that predicts (220) final audio synthesis of the input text. As noted above, speaker embeddings 170 may be used in the process 200 to cause the synthesized audio 160 to exhibit one or more audio characteristics (e.g., a male voice, a female voice, a particular accent, etc.) associated with a speaker identifier or speaker embedding.

Next, each of these components and the data processing are described in more detail. Example model hyperparameters are available in Table 4 within Appendix 3.

1. Text Preprocessing

Text preprocessing can be important for good performance. Feeding raw text (characters with spacing and punctuation) yields acceptable performance on many utterances. However, some utterances may have mispronunciations of rare words, or may yield skipped words and repeated words. In one or more embodiments, these issues may be alleviated by normalizing the input text as follows:

1. Uppercase all characters in the input text.
2. Remove all intermediate punctuation marks.
3. End every utterance with a period or question mark.
4. Replace spaces between words with special separator characters which indicate the duration of pauses inserted by the speaker between words. In one or more embodiments, four different word separators may be used, indicating (i) slurred-together words, (ii) standard pronunciation and space characters, (iii) a short pause between words, and (iv) a long pause between words. For example, the sentence "Either way, you should shoot very slowly," with a long pause after "way" and a short pause after "shoot", would be written as "Either way % you should shoot/very slowly %." with % representing a long pause and/representing a short pause for encoding convenience. In one or more embodiments, the pause durations may be obtained through either manual labeling or estimated by a text-audio aligner such as Gentle (Ochshorn & Hawkins, 2017). In one or more embodiments, the single-speaker dataset was labeled by hand, and the multi-speaker datasets were annotated using Gentle.

2. Joint Representation of Characters and Phonemes

Deployed TTS systems should, in one or more embodiments, preferably include a way to modify pronunciations to correct common mistakes (which typically involve, for example, proper nouns, foreign words, and domain-specific jargon). A conventional way to do this is to maintain a dictionary to map words to their phonetic representations.

In one or more embodiments, the model can directly convert characters (including punctuation and spacing) to acoustic features, and hence learns an implicit grapheme-to-phoneme model. This implicit conversion can be difficult to correct when the model makes mistakes. Thus, in addition to character models, in one or more embodiments, phoneme-only models and/or mixed character-and-phoneme models may be trained by allowing phoneme input option explicitly. In one or more embodiments, these models may be identical to character-only models, except that the input layer of the encoder sometimes receives phoneme and phoneme stress embeddings instead of character embeddings.

In one or more embodiments, a phoneme-only model requires a preprocessing step to convert words to their phoneme representations (e.g., by using an external phoneme dictionary or a separately trained grapheme-to-phoneme model). For embodiments, Carnegie Mellon University Pronouncing Dictionary, CMUDict 0.6b, was used. In one or more embodiments, a mixed character-and-phoneme model requires a similar preprocessing step, except for words not in the phoneme dictionary. These out-of-vocabulary/out-of-dictionary words may be input as characters, allowing the model to use its implicitly learned grapheme-to-phoneme model. While training a mixed character-and-phoneme model, every word is replaced with its phoneme representation with some fixed probability at each training iteration. It was found that this improves pronunciation accuracy and minimizes attention errors, especially when generalizing to utterances longer than those seen during training. More importantly, models that support phoneme representation allow correcting mispronunciations using a phoneme dictionary, a desirable feature of deployed systems.

In one or more embodiments, the text embedding model 110 may comprise a phoneme-only model and/or a mixed character-and-phoneme model.

3. Convolution Blocks for Sequential Processing

By providing a sufficiently large receptive field, stacked convolutional layers can utilize long-term context information in sequences without introducing any sequential dependency in computation. In one or more embodiments, a convolution block is used as a main sequential processing unit to encode hidden representations of text and audio.

Figure 3:
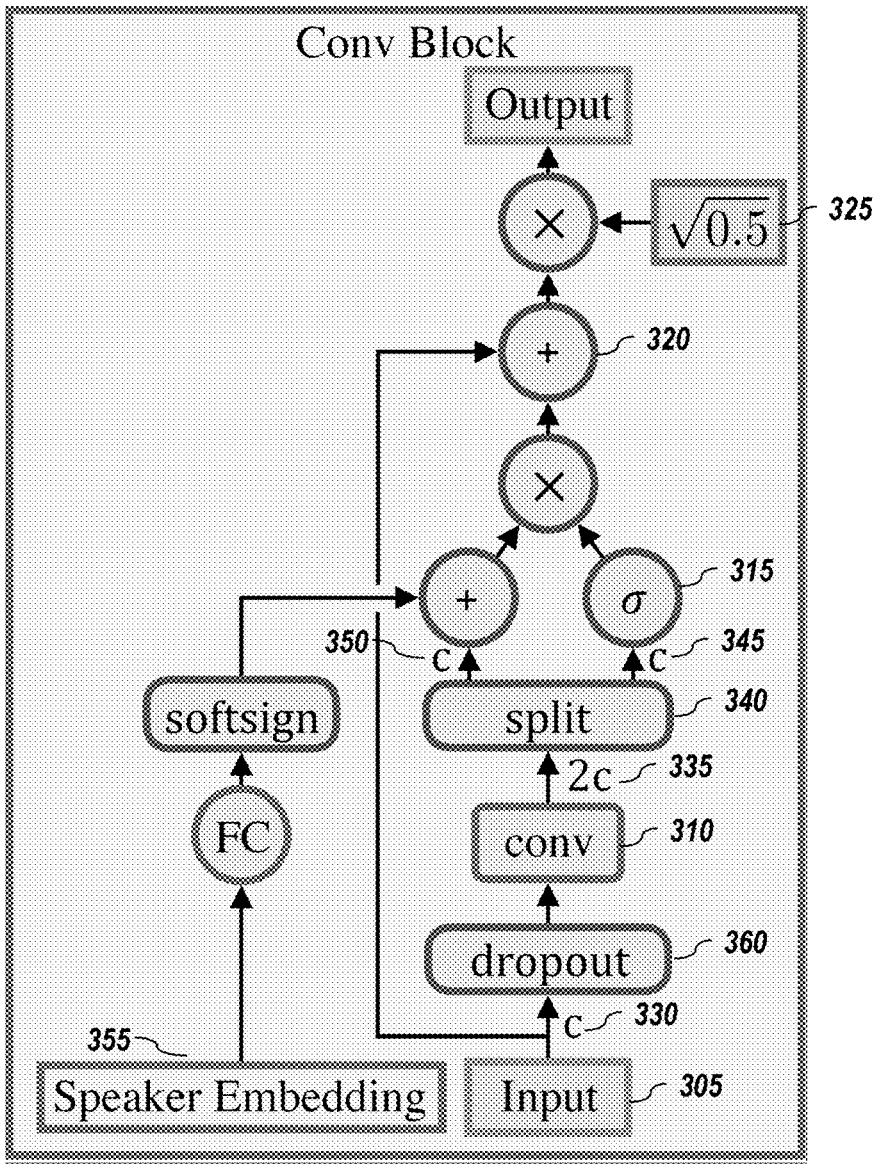
FIG. 3 graphically depicts a convolution block comprising a one-dimensional (1D) convolution with gated linear unit, and residual connection, according to embodiments of the present disclosure.

FIG. 3 graphically depicts a convolution block comprising a one-dimensional (1D) convolution with gated linear unit, and residual connection, according to embodiments of the present disclosure. In one or more embodiments, the convolution block 300 comprises a one-dimensional (1D) convolution filter 310, a gated-linear unit 315 as a learnable nonlinearity, a residual connection 320 to the input 305, and a scaling factor 325. In the depicted embodiment, the scaling factor is $\sqrt{0.5}$, although different values may be used. The scaling factor helps ensures that the input variance is preserved early in training. In the depicted embodiment in FIG. 3, c (330) denotes the dimensionality of the input 305, and the convolution output of size 2·c (335) may be split 340 into equal-sized portions: the gate vector 345 and the input vector 350. The gated linear unit provides a linear path for the gradient flow, which alleviates the vanishing gradient issue for stacked convolution blocks while retaining nonlinearity. In one or more embodiments, to introduce speaker-dependent control, a speaker-dependent embedding 355 may be added as a bias to the convolution filter output, after a softsign function. In one or more embodiments, a softsign nonlinearity is used because it limits the range of the output while also avoiding the saturation problem that exponential-based nonlinearities sometimes exhibit. In one or more embodiments, the convolution filter weights are initialized with zero-mean and unit-variance activations throughout the entire network.

The convolutions in the architecture may be either non-causal (e.g., in encoder 105/705 and converter 150/750) or causal (e.g., in decoder 130/730). In one or more embodiments, to preserve the sequence length, inputs are padded with k−1 timesteps of zeros on the left for causal convolutions and (k−1)/2 timesteps of zeros on the left and on the right for non-causal convolutions, where k is an odd convolution filter width (in embodiments, odd convolution widths were used to simplify the convolution arithmetic, although even convolutions widths and even k values may be used). In one or more embodiments, dropout 360 is applied to the inputs prior to the convolution for regularization.

4. Encoder

In one or more embodiments, the encoder network (e.g., encoder 105/705) begins with an embedding layer, which converts characters or phonemes into trainable vector representations, $h_e$. In one or more embodiments, these embeddings $h_e$ are first projected via a fully-connected layer from the embedding dimension to a target dimensionality. Then, in one or more embodiments, they are processed through a series of convolution blocks (such as the embodiments described in Section C.3) to extract time-dependent text information. Lastly, in one or more embodiments, they are projected back to the embedding dimension to create the attention key vectors $h_k$. The attention value vectors may be computed from attention key vectors and text embeddings, $h_v=\sqrt{0.5}\,(h_k+h_e)$, to jointly consider the local information in $h_e$ and the long-term context information in $h_k$. The key vectors $h_k$ are used by each attention block to compute attention weights, whereas the final context vector is computed as a weighted average over the value vectors $h_v$ (see Section C.6).

5. Decoder

In one or more embodiments, the decoder network (e.g., decoder 130/730) generates audio in an autoregressive manner by predicting a group of r future audio frames conditioned on the past audio frames. Since the decoder is autoregressive, in embodiments, it uses causal convolution blocks. In one or more embodiments, a mel-band log-magnitude spectrogram was chosen as the compact low-dimensional audio frame representation, although other representations may be used. It was empirically observed that decoding multiple frames together (i.e., having r>1) yields better audio quality.

In one or more embodiments, the decoder network starts with a plurality of fully-connected layers with rectified linear unit (ReLU) nonlinearities to preprocess input mel-spectrograms (denoted as "PreNet" in FIG. 1). Then, in one or more embodiments, it is followed by a series of decoder blocks, in which a decoder block comprises a causal convolution block and an attention block. These convolution blocks generate the queries used to attend over the encoder's hidden states (see Section C.6). Lastly, in one or more embodiments, a fully-connected layer outputs the next group of r audio frames and also a binary "final frame" prediction (indicating whether the last frame of the utterance has been synthesized). In one or more embodiments, dropout is applied before each fully-connected layer prior to the attention blocks, except for the first one.

An L1 loss may be computed using the output mel-spectrograms, and a binary cross-entropy loss may be computed using the final-frame prediction. L1 loss was selected since it yielded the best result empirically. Other losses, such as L2, may suffer from outlier spectral features, which may correspond to non-speech noise.

6. Attention Block

Figure 4:
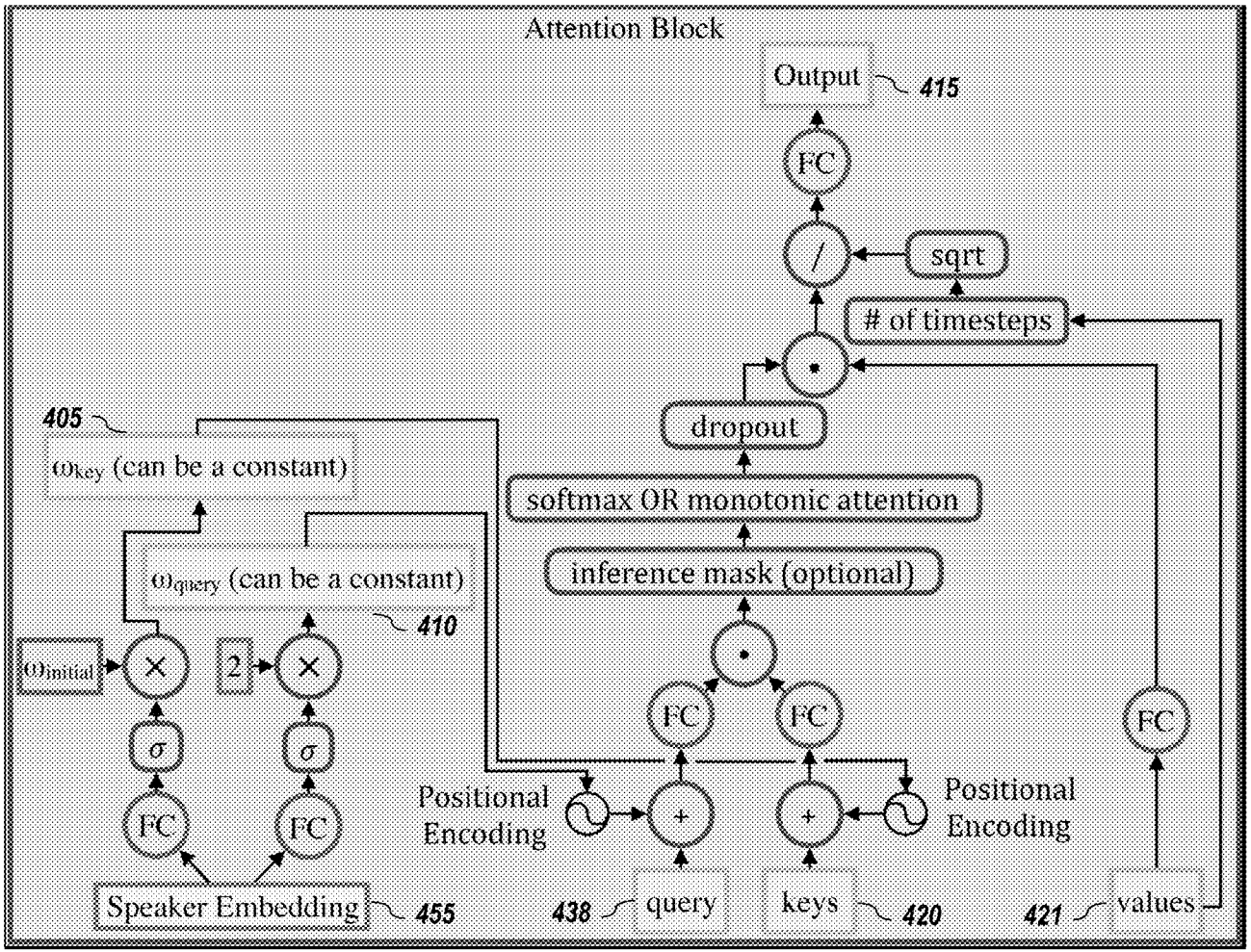
FIG. 4 graphically depicts an embodiment of an attention block, according to embodiments of the present disclosure.

FIG. 4 graphically depicts an embodiment of an attention block, according to embodiments of the present disclosure. As shown in FIG. 4, in one or more embodiments, positional encodings 405, 410 may be added to both keys 420 and query 438 vectors, with rates of $\omega_{key}$ 405 and $\omega_{query}$ 410, respectively. Forced monotonocity may be applied at inference by adding a mask of large negative values to the logits. One of two possible attention schemes may be used: softmax or monotonic attention (such as, for example, from Raffel et al. (2017)). In one or more embodiments, during training, attention weights are dropped out.

In one or more embodiments, a dot-product attention mechanism (depicted in FIG. 4) is used. In one or more embodiments, the attention mechanism uses a query vector 438 (the hidden states of the decoder) and the per-timestep key vectors 420 from the encoder to compute attention weights, and then outputs a context vector 415 computed as the weighted average of the value vectors 421.

Empirical benefits were observed from introducing an inductive bias where the attention follows a monotonic progression in time. Thus, in one or more embodiments, a positional encoding was added to both the key and the query vectors. These positional encodings $h_p$ may be chosen as $h_p(i)=\sin(\omega_s i/10000^{k/d})$ (for even i) or $\cos(\omega_s i/10000^{k/d})$ (for odd i), where i is the timestep index, k is the channel index in the positional encoding, d is the total number of channels in the positional encoding, and $\omega_s$ is the position rate of the encoding. In one or more embodiments, the position rate dictates the average slope of the line in the attention distribution, roughly corresponding to speed of speech. For a single speaker, $\omega_s$ may be set to one for the query and may be fixed for the key to the ratio of output timesteps to input timesteps (computed across the entire dataset). For multi-speaker datasets, $\omega_s$ may be computed for both the key and the query from the speaker embedding 455 for each speaker (e.g., depicted in FIG. 4). As sine and cosine functions form an orthonormal basis, this initialization yields an attention distribution in the form of a diagonal line (see FIG. 5A). In one or more embodiments, the fully-connected layer weights used to compute hidden attention vectors are initialized to the same values for the query projection and the key projection. Positional encodings may be used in all attention blocks. In one or more embodiments, a context normalization (such as, for example, in Gehring et al. (2017) was used. In one or more embodiments, a fully-connected layer is applied to the context vector to generate the output of the attention block. Overall, positional encodings improve the convolutional attention mechanism.

Figure 5A:
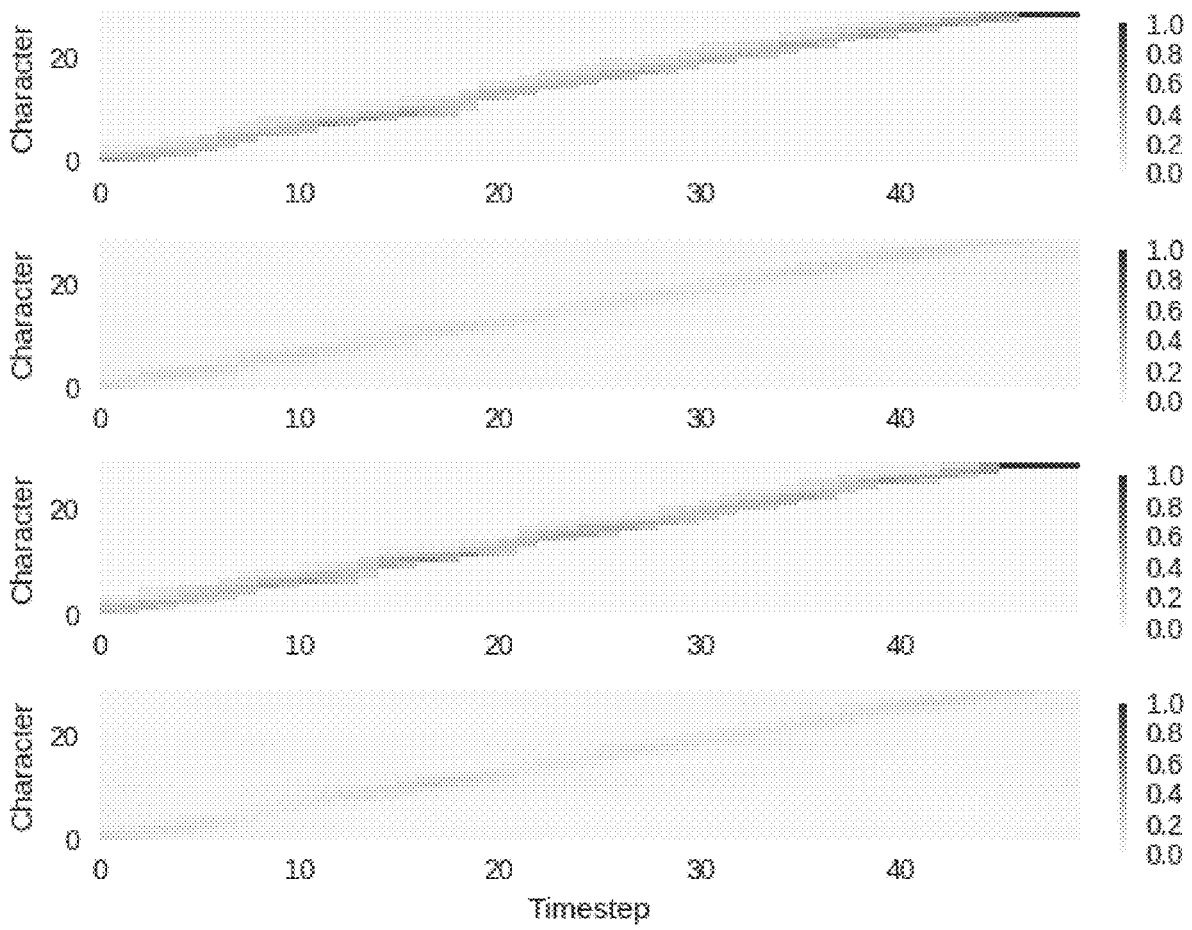
FIG. 5A-C depicts attention distributions: (5A) before training, (5B) after training, but without inference constraints, and (5C) with inference constraints applied to the first and third layers, according to embodiments of the present disclosure.
Figure 5B:
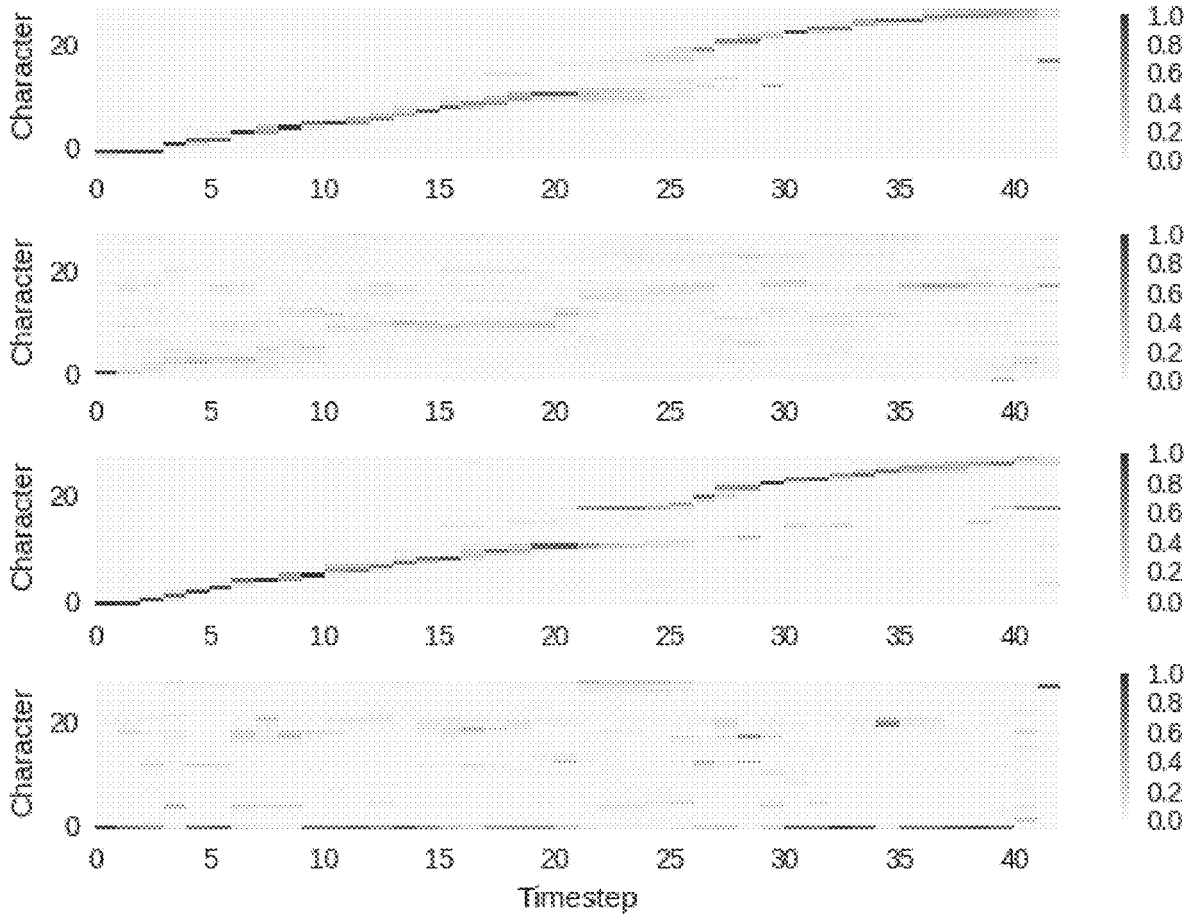
Figure 5C:
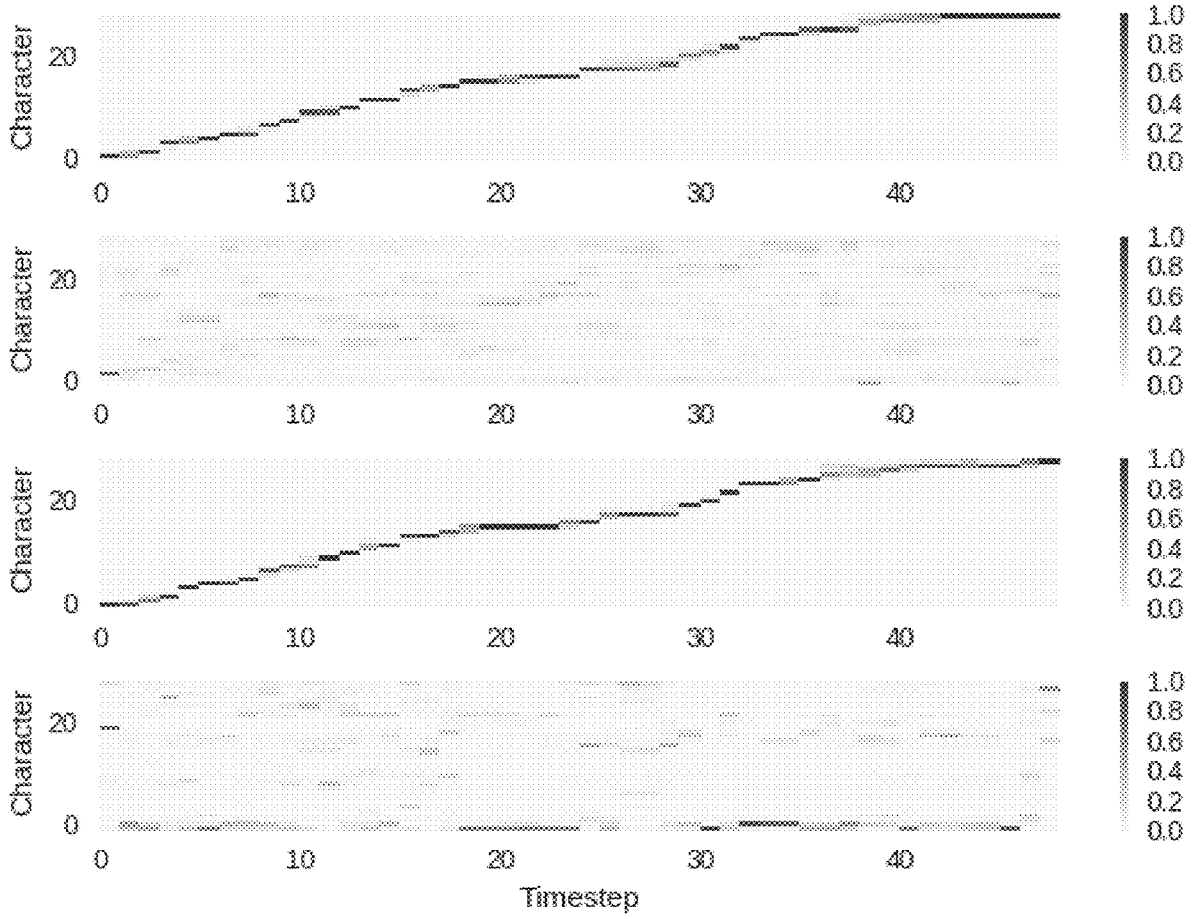

Production-quality TTS systems have very low tolerance for attention errors. Hence, besides positional encodings, additional strategies were considered to eliminate the cases of repeating or skipping words. One approach which may be used is to substitute the canonical attention mechanism with the monotonic attention mechanism introduced in Raffel et al. (2017), which approximates hard-monotonic stochastic decoding with soft-monotonic attention by training in expectation. Raffel et al. (2017) also proposes hard monotonic attention process by sampling. It aimed to improve the inference speed by only attending over states that are selected via sampling, and thus avoiding computing over future states. Embodiments herein do not benefit from such speedup, and poor attention behavior in some cases, e.g., being stuck on the first or last character, were observed. Despite the improved monotonicity, this strategy may yield a more diffused attention distribution. In some cases, several characters are attended at the same time and high-quality speech could not be obtained. This may be attributed to the unnormalized attention coefficients of the soft alignment, potentially resulting in weak signal from the encoder. Thus, in one or more embodiments, an alternative strategy of constraining attention weights only at inference to be monotonic, preserving the training procedure without any constraints, was used. Instead of computing the softmax over the entire input, the softmax may be computed over a fixed window starting at the last attended-to position and going forward several timesteps. In experiments herein, a window size of three was used, although other window sizes may be used. In one or more embodiments, the initial position is set to zero and is later computed as the index of the highest attention weight within the current window. This strategy also enforces monotonic attention at inference as shown in FIG. 5AC and yields superior speech quality.

7. Converter

In one or more embodiments, the converter network (e.g., 150/750) takes as inputs the activations from the last hidden layer of the decoder, applies several non-causal convolution blocks, and then predicts parameters for downstream vocoders. In one or more embodiments, unlike the decoder, the converter is non-causal and non-autoregressive, so it can use future context from the decoder to predict its outputs.

In embodiments, the loss function of the converter network depends on the type of downstream vocoders:

1. Griffin-Lim Vocoder:

In one or more embodiments, the Griffin-Lim algorithm converts spectrograms to time-domain audio waveforms by iteratively estimating the unknown phases. It was found that raising the spectrogram to a power parametrized by a sharpening factor before waveform synthesis is helpful for improved audio quality. L1 loss is used for prediction of linear-scale log-magnitude spectrograms.

Figure 6:
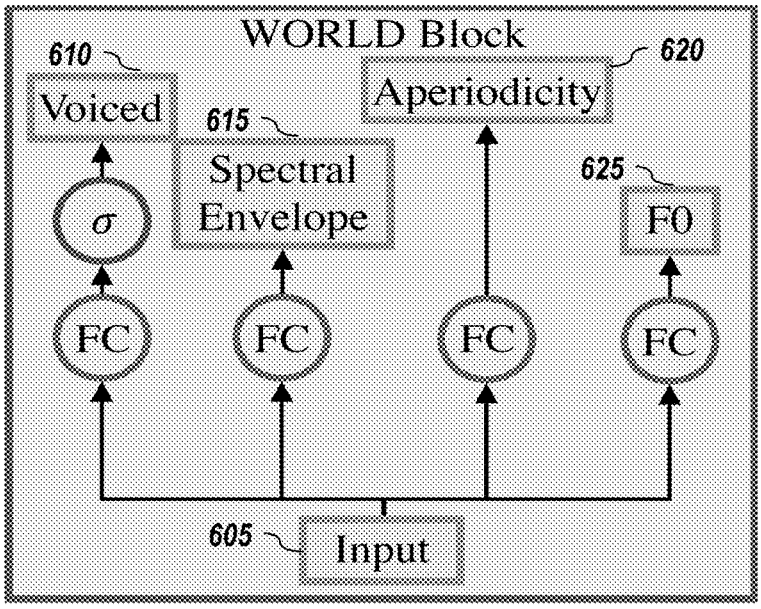
FIG. 6 graphically depicts four fully-connected layers generating WORLD features, according to embodiments of the present disclosure.

2. WORLD Vocoder:

In one or more embodiments, the WORLD vocoder is based on Morise et al., 2016. FIG. 6 graphically depicts an example generated WORLD vocoder parameters with fully connected (FC) layers, according to embodiments of the present disclosure. In one or more embodiments, as vocoder parameters, a boolean value 610 (whether the current frame is voiced or unvoiced), an FO value 625 (if the frame is voiced), the spectral envelope 615, and the aperiodicity parameters 620 are predicted. In one or more embodiments, a cross-entropy loss was used for the voiced-unvoiced prediction, and L1 losses for all other predictions. In embodiments, the "σ" is the sigmoid function, which is used to obtain a bounded variable for binary cross entropy prediction. In one or more embodiments, the input 605 is the output hidden states in the converter.

3. WaveNet Vocoder:

In one or more embodiments, a WaveNet was separately trained to be used as a vocoder treating mel-scale log-magnitude spectrograms as vocoder parameters. These vocoder parameters are input as external conditioners to the network. The WaveNet may be trained using ground-truth mel-spectrograms and audio waveforms. The architecture besides the conditioner is similar to the WaveNet described in Deep Voice 2. While the WaveNet in certain embodiments of Deep Voice 2 is conditioned with linear-scale log-magnitude spectrograms, good performance was observed with mel-scale spectrograms, which corresponds to a more compact representation of audio. In addition to L1 loss on mel-scale spectrograms at decode, L1 loss on linear-scale spectrogram may also be applied as Griffin-Lim vocoder.

D. RESULTS

It shall be noted that these experiments and results are provided by way of illustration and were performed under specific conditions using a specific embodiment or embodiments; accordingly, neither these experiments nor their results shall be used to limit the scope of the disclosure of the current patent document.

In this section, several different experiments and metrics to evaluate speech synthesis system embodiments. Also, the performance of system embodiments is quantified and compared to other recently published neural TTS systems.

1. Data

For single-speaker synthesis, an internal English speech dataset containing approximately 20 hours of audio with a sampling rate of 48 KHz was used. For multi-speaker synthesis, the VCTK and LibriSpeech datasets were used. The VCTK dataset contains audio for 108 speakers, with a total duration of ~44 hours. The LibriSpeech dataset contains audio for 2484 speakers, with a total duration of ~820 hours. The sample rate is 48 KHz for VCTK and 16 KHz for LibriSpeech.

2. Fast Training

A Deep Voice 3 embodiment was compared to Tacotron, a recently published attention-based TTS system. For the tested Deep Voice 3 system embodiment on single-speaker data, the average training iteration time (for batch size 4) was 0.06 seconds using one GPU as opposed to 0.59 seconds for Tacotron, indicating a ten-fold increase in training speed. In addition, the Deep Voice 3 embodiment converged after ~500K iterations for all three datasets in the experiment, while Tacotron requires ~2M iterations. This significant speedup is due, at least in part, to the fully-convolutional architecture of the Deep Voice 3 embodiment, which highly exploits the parallelism of a GPU during training.

3. Attention Error Modes

Attention-based neural TTS systems may run into several error modes that can reduce synthesis quality—including (1) repeated words, (ii) mispronunciations, and (iii) skipped words. As an example, consider the phrase "DOMINANT VEGETARIAN," which should be pronounced with phonemes "D AA M AH N AH N T. V EH JH AH T EH R IY AH N." The following are example errors for the above three error modes:

(i)"D AA M AH N AH N T. V EH JH AH T EH T EH R IY AH N.";

(ii) "D AE M AH N AE N T. V EH JH AH T EH R IY AH N."; and (iii) "D AH N T. V EH JH AH T EH R IY AH N."

One reason for (i) and (iii) is that the attention-based model embodiment does not impose a monotonically progressing mechanism. To track the occurrence of attention errors, a custom 100-sentence test set (see Appendix 5) was constructed that includes particularly-challenging cases from deployed TTS systems (e.g. dates, acronyms, URLs, repeated words, proper nouns, foreign words etc.). Attention error counts are listed in Table 1 and indicate that the model with joint representation of characters and phonemes, trained with standard attention mechanism but enforced the monotonic constraint at inference, largely outperforms other approaches.

TABLE 1

Attention errors counts of single-speaker Deep Voice 3 model embodiments on the 100-sentence test set, which is given in Appendix 5. One or more mispronunciations, skips, and repeats count as a single mistake per utterance. "Phonemes & Characters" refers to the model embodiment trained with a joint character and phoneme representation, as discussed in Section C.2. Phoneme-only models were not included because the test set contains out-of-vocabulary words. All model embodiments used Griffin-Lim as their vocoder.

| Text Input | Attention | Inference Constraints | Repeated | Mispronounced | Skipped |
|---|---|---|---|---|---|
| Characters only | Dot-Product | Yes | 3 | 35 | 19 |
| Phonemes & Characters | Dot-Product | No | 12 | 10 | 15 |
| Phonemes & Characters | Dot-Product | Yes | 1 | 4 | 3 |
| Phonemes & Characters | Monotonic | No | 5 | 9 | 11 |

4. Naturalness

It was demonstrated that choice of waveform synthesis matters for naturalness ratings and compared it to other published neural TTS systems. Results in Table 2 indicate that WaveNet, a neural vocoder, achieves the highest MOS of 3.78, followed by WORLD and Griffin-Lim at 3.63 and 3.62, respectively. Thus, it was shown that the most natural waveform synthesis may be done with a neural vocoder and that basic spectrogram inversion techniques can match advanced vocoders with high quality single speaker data. The WaveNet vocoder embodiment sounds more natural as the WORLD vocoder introduces various noticeable artifacts. Yet, lower inference latency may render the WORLD vocoder preferable: the heavily engineered WaveNet implementation runs at 3× realtime per CPU core, while WORLD runs up to 40× realtime per CPU core (see the subsection below).

TABLE 2

Mean Opinion Score (MOS) ratings with 95% confidence intervals using different waveform synthesis methods. The crowdMOS toolkit (Ribeiro et al., 2011) was used; batches of samples from these models were presented to raters on Mechanical Turk. Since batches contained samples from all models, the experiment naturally induces a comparison between the models.

| Model Embodiment | Mean Opinion Score (MOS) |
|---|---|
| Deep Voice 3 (Griffin-Lim) | 3.62 ± 0.31 |
| Deep Voice 3 (WORLD) | 3.63 ± 0.27 |
| Deep Voice 3 (WaveNet) | 3.78 ± 0.30 |
| Tacotron (WaveNet) | 3.78 ± 0.34 |
| Deep Voice 2 (WaveNet) | 2.74 ± 0.35 |

5. Multi-Speaker Synthesis

To demonstrate that model embodiments are capable of handling multi-speaker speech synthesis effectively, model embodiments were trained on the VCTK and LibriSpeech datasets.

For LibriSpeech (an ASR dataset), a preprocessing step of standard denoising (using for example SoX (Bagwell, 2017)) and splitting long utterances into multiple utterances at pause locations (which were determined by Gentle (Ochshorn & Hawkins, 2017)). Results are presented in Table 3. The ground-truth samples were purposely included in the set being evaluated because the accents in datasets are likely to be unfamiliar to North American crowdsourced raters. The model embodiment with the WORLD vocoder achieves a comparable MOS of 3.44 on VCTK in contrast to 3.69 from a Deep Voice 2 embodiment, which is a state-of-the art multi-speaker neural TTS system using WaveNet as vocoder and separately optimized phoneme duration and fundamental frequency prediction models. Further improvement is expected by using WaveNet for multi-speaker synthesis, although it may slow down inference. The MOS on LibriSpeech is lower compared to VCTK, which may be mainly attributed to the lower quality of the training dataset due to the various recording conditions and noticeable background noise. The Deep Voice 3 embodiment was tested on a subsampled LibriSpeech dataset with only 108 speakers (same as VCTK), and worse quality of generated samples than VCTK were observed. In the literature, Yamagishi et al. (2010) also observes worse performance, when apply parametric TTS method to different ASR datasets with hundreds of speakers. Lastly, it was found that the learned speaker embeddings lie in a meaningful latent space (see FIGS. 8A and 8B in Appendix 4).

TABLE 3

Mean Opinion Score (MOS) ratings with 95% confidence intervals for audio clips from neural TTS systems on multi-speaker datasets are shown. The crowdMOS toolkit was also used; batches of samples including ground truth were presented to human raters. The multi-speaker Tacotron implementation and hyperparameters were based on Deep Voice 2 embodiments. The Deep Voice 2 embodiment system and Tacotron system were not trained for the LibriSpeech dataset due to prohibitively long time required to optimize hyperparameters.

| Model | Mean Opinion Score (VCTK) | Mean Opinion Score (LibriSpeech) |
|---|---|---|
| Deep Voice 3 (Griffin-Lim) | 3.01 ± 0.29 | 2.37 ± 0.24 |
| Deep Voice 3 (WORLD) | 3.44 ± 0.32 | 2.89 ± 0.38 |
| Deep Voice 2 (WaveNet) | 3.69 ± 0.23 | — |
| Tacotron (Griffin-Lim) | 2.07 ± 0.31 | — |
| Ground Truth | 4.69 ± 0.04 | 4.51 ± 0.18 |

6. Optimizing Inference for Deployment

To deploy a neural TTS system in a cost-effective manner, the system should be able to handle as much traffic as alternative systems on a comparable amount of hardware. To do so, a throughput of ten million queries per day or 116 queries per second (QPS) (in which a query was defined as synthesizing the audio for a one-second utterance) on a single-GPU server with twenty CPU cores was a target, which was found to be comparable in cost to commercially deployed TTS systems. By implementing custom GPU kernels for Deep Voice 3 architecture embodiments and parallelizing WORLD synthesis across CPUs, it was demonstrated that the model embodiments can handle ten million queries per day. More details on the implementation are provided in Appendix 2.

E. SOME CONCLUSIONS

Presented herein are embodiments of a neural text-to-speech system based on a novel fully-convolutional sequence-to-sequence acoustic model with a position-augmented attention mechanism. Embodiments of this system may be referred to as Deep Voice 3. Common error modes in sequence-to-sequence speech synthesis models are described and it was shown that Deep Voice 3 embodiments successfully avoid these common error modes. It was shown that model embodiments are agnostic of the waveform synthesis method, and that embodiments may be adapted for Griffin-Lim spectrogram inversion, WaveNet, and WORLD vocoder synthesis. It was also demonstrated that architecture embodiments are capable of multi-speaker speech synthesis by augmenting the embodiments with trainable speaker embeddings. Finally, production-ready Deep Voice 3 system embodiments are described including text normalization and performance characteristics, and an embodiment's state-of-the-art quality is demonstrated through extensive MOS evaluations. One skilled in the art shall recognize that embodiments may include changes to help improve the implicitly learned grapheme-to-phoneme model, jointly training with a neural vocoder, and training on cleaner and larger datasets to scale to model the full variability of human voices and accents from hundreds of thousands of speakers.

F. SYSTEM EMBODIMENTS

In embodiments, aspects of the present patent document may be directed to, may include, or may be implemented on one or more information handling systems/computing systems. A computing system may include any instrumentality or aggregate of instrumentalities operable to compute, calculate, determine, classify, process, transmit, receive, retrieve, originate, route, switch, store, display, communicate, manifest, detect, record, reproduce, handle, or utilize any form of information, intelligence, or data. For example, a computing system may be or may include a personal computer (e.g., laptop), tablet computer, phablet, personal digital assistant (PDA), smart phone, smart watch, smart package, server (e.g., blade server or rack server), a network storage device, camera, or any other suitable device and may vary in size, shape, performance, functionality, and price. The computing system may include random access memory (RAM), one or more processing resources such as a central processing unit (CPU) or hardware or software control logic, ROM, and/or other types of memory. Additional components of the computing system may include one or more disk drives, one or more network ports for communicating with external devices as well as various input and output (I/O) devices, such as a keyboard, a mouse, touchscreen and/or a video display. The computing system may also include one or more buses operable to transmit communications between the various hardware components.

Figure 9:
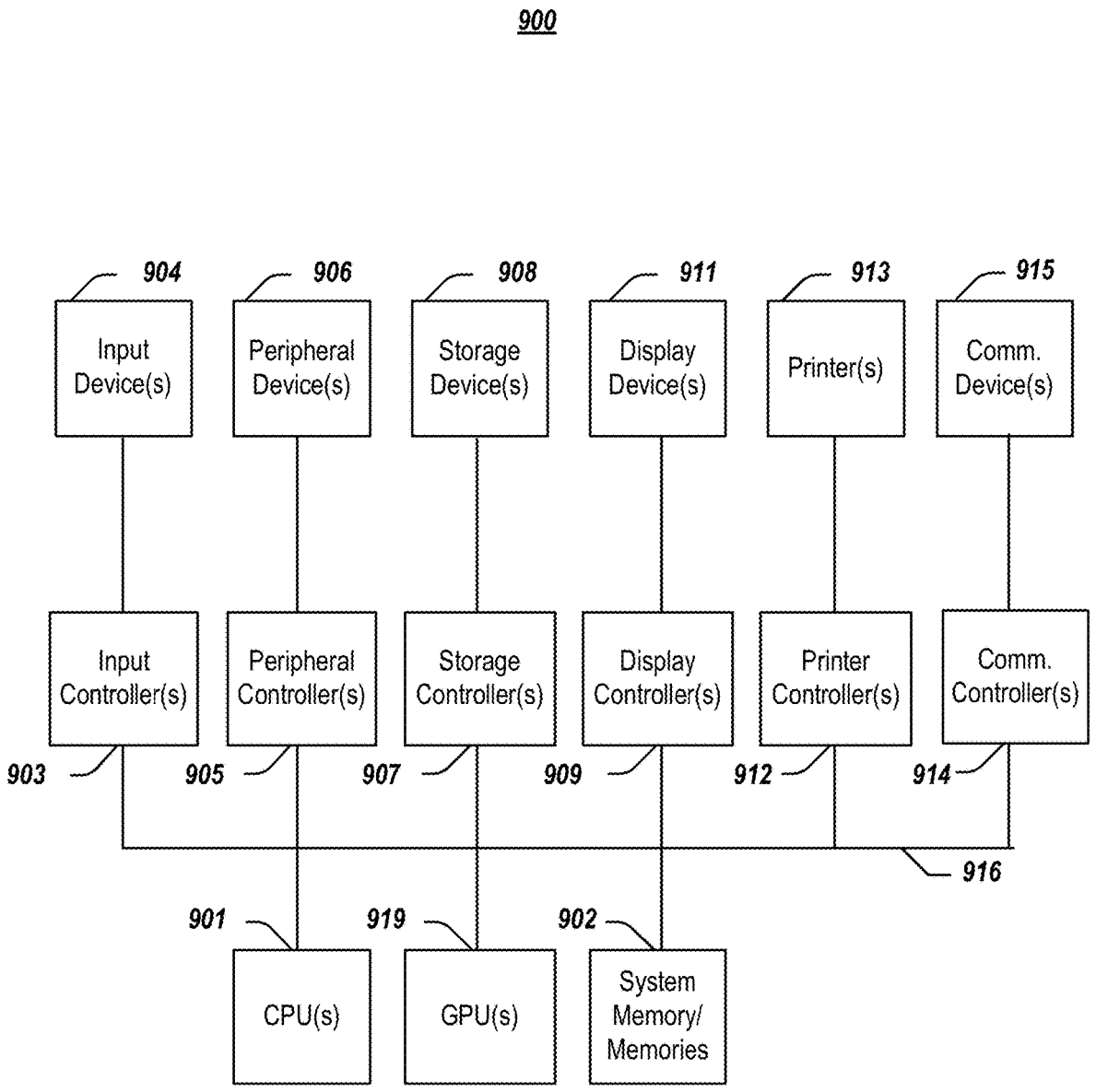
FIG. 9 depicts a simplified block diagram of a computing device/information handling system, in accordance with embodiments of the present document.

FIG. 9 depicts a simplified block diagram of a computing device/information handling system (or computing system) according to embodiments of the present disclosure. It will be understood that the functionalities shown for system 900 may operate to support various embodiments of a computing system—although it shall be understood that a computing system may be differently configured and include different components, including having fewer or more components as depicted in FIG. 9.

As illustrated in FIG. 9, the computing system 900 includes one or more central processing units (CPU) 901 that provides computing resources and controls the computer. CPU 901 may be implemented with a microprocessor or the like, and may also include one or more graphics processing units (GPU) 919 and/or a floating-point coprocessor for mathematical computations. System 900 may also include a system memory 902, which may be in the form of random-access memory (RAM), read-only memory (ROM), or both.

A number of controllers and peripheral devices may also be provided, as shown in FIG. 9. An input controller 903 represents an interface to various input device(s) 904, such as a keyboard, mouse, touchscreen, and/or stylus. The computing system 900 may also include a storage controller 907 for interfacing with one or more storage devices 908 each of which includes a storage medium such as magnetic tape or disk, or an optical medium that might be used to record programs of instructions for operating systems, utilities, and applications, which may include embodiments of programs that implement various aspects of the present invention. Storage device(s) 908 may also be used to store processed data or data to be processed in accordance with the invention. The system 900 may also include a display controller 909 for providing an interface to a display device 911, which may be a cathode ray tube (CRT), a thin film transistor (TFT) display, organic light-emitting diode, electroluminescent panel, plasma panel, or other type of display. The computing system 900 may also include one or more peripheral controllers or interfaces 905 for one or more peripherals 906. Examples of peripherals may include one or more printers, scanners, input devices, output devices, sensors, and the like. A communications controller 914 may interface with one or more communication devices 915, which enables the system 900 to connect to remote devices through any of a variety of networks including the Internet, a cloud resource (e.g., an Ethernet cloud, a Fiber Channel over Ethernet (FCoE)/Data Center Bridging (DCB) cloud, etc.), a local area network (LAN), a wide area network (WAN), a storage area network (SAN) or through any suitable electromagnetic carrier signals including infrared signals.

In the illustrated system, all major system components may connect to a bus 916, which may represent more than one physical bus. However, various system components may or may not be in physical proximity to one another. For example, input data and/or output data may be remotely transmitted from one physical location to another. In addition, programs that implement various aspects of the invention may be accessed from a remote location (e.g., a server) over a network. Such data and/or programs may be conveyed through any of a variety of machine-readable medium including, but are not limited to: magnetic media such as hard disks, floppy disks, and magnetic tape; optical media such as CD-ROMs and holographic devices; magneto-optical media; and hardware devices that are specially configured to store or to store and execute program code, such as application specific integrated circuits (ASICs), programmable logic devices (PLDs), flash memory devices, and ROM and RAM devices.

Aspects of the present invention may be encoded upon one or more non-transitory computer-readable media with instructions for one or more processors or processing units to cause steps to be performed. It shall be noted that the one or more non-transitory computer-readable media shall include volatile and non-volatile memory. It shall be noted that alternative implementations are possible, including a hardware implementation or a software/hardware implementation. Hardware-implemented functions may be realized using ASIC(s), programmable arrays, digital signal processing circuitry, or the like. Accordingly, the "means" terms in any claims are intended to cover both software and hardware implementations. Similarly, the term "computer-readable medium or media" as used herein includes software and/or hardware having a program of instructions embodied thereon, or a combination thereof. With these implementation alternatives in mind, it is to be understood that the figures and accompanying description provide the functional information one skilled in the art would require to write program code (i.e., software) and/or to fabricate circuits (i.e., hardware) to perform the processing required.

It shall be noted that embodiments of the present invention may further relate to computer products with a non-transitory, tangible computer-readable medium that have computer code thereon for performing various computer-implemented operations. The media and computer code may be those specially designed and constructed for the purposes of the present invention, or they may be of the kind known or available to those having skill in the relevant arts. Examples of tangible computer-readable media include, but are not limited to: magnetic media such as hard disks, floppy disks, and magnetic tape; optical media such as CD-ROMs and holographic devices; magneto-optical media; and hardware devices that are specially configured to store or to store and execute program code, such as application specific integrated circuits (ASICs), programmable logic devices (PLDs), flash memory devices, and ROM and RAM devices. Examples of computer code include machine code, such as produced by a compiler, and files containing higher level code that are executed by a computer using an interpreter. Embodiments of the present invention may be implemented in whole or in part as machine-executable instructions that may be in program modules that are executed by a processing device. Examples of program modules include libraries, programs, routines, objects, components, and data structures. In distributed computing environments, program modules may be physically located in settings that are local, remote, or both.

One skilled in the art will recognize no computing system or programming language is critical to the practice of the present invention. One skilled in the art will also recognize that a number of the elements described above may be physically and/or functionally separated into sub-modules or combined together.

It will be appreciated to those skilled in the art that the preceding examples and embodiments are exemplary and not limiting to the scope of the present disclosure. It is intended that all permutations, enhancements, equivalents, combinations, and improvements thereto that are apparent to those skilled in the art upon a reading of the specification and a study of the drawings are included within the true spirit and scope of the present disclosure. It shall also be noted that elements of any claims may be arranged differently including having multiple dependencies, configurations, and combinations.

G. APPENDICES

1. Detailed Model Architecture Embodiment of Deep Voice 3

FIG. 7 graphically depicts an example detailed Deep Voice 3 model architecture, according to embodiments of the present disclosure. In one or more embodiments, the model 700 uses a deep residual convolutional network to encode text and/or phonemes into per-timestep key 720 and value 722 vectors for an attentional decoder 730. In one or more embodiments, the decoder 730 uses these to predict the mel-band log magnitude spectrograms 742 that correspond to the output audio. The dotted arrows 746 depict the autoregressive synthesis process during inference. In one or more embodiments, the hidden state of the decoder is fed to a converter network 750 to output linear spectrograms for Griffin-Lim 752A or parameters for WORLD 752B, which can be used to synthesize the final waveform. In one or more embodiments, weight normalization is applied to all convolution filters and fully-connected layer weight matrices in the model. As illustrated in the embodiment depicted in FIG. 7, WaveNet 752 does not require a separate converter as it takes as input mel-band log magnitude spectrograms.

speed of 115 QPS was achieved, which corresponds to a target ten million queries per day. In embodiments, WORLD synthesis was parallelized across all 20 CPUs on the server, permanently pinning threads to CPUs in order to maximize cache performance. In this setup, GPU inference is the bottleneck, as WORLD synthesis on 20 cores is faster than 115 QPS. Inference may be made faster through more optimized kernels, smaller models, and fixed-precision arithmetic.

3. Model Hyperparameters

All hyperparameters of the models used in this patent document are provided in Table 4, below.

TABLE 4

Hyperparameters used for best models for the three datasets used in the patent document.

| Parameter | Single-Speaker | VCTK | LibriSpeech |
|---|---|---|---|
| FFT Size | 4096 | 4096 | 4096 |
| FFT Window Size/Shift | 2400/600 | 2400/600 | 1600/400 |
| Audio Sample Rate | 48000 | 48000 | 16000 |
| Reduction Factor r | 4 | 4 | 4 |
| Mel Bands | 80 | 80 | 80 |
| Sharpening Factor | 1.4 | 1.4 | 1.4 |
| Character Embedding Dim. | 256 | 256 | 256 |
| Encoder Layers/Conv. Width/Channels | 7/5/64 | 7/5/128 | 7/5/256 |
| Decoder Affine Size | 128, 256 | 128, 256 | 128, 256 |
| Decoder Layers/Conv. Width | 4/5 | 6/5 | 8/5 |
| Attention Hidden Size | 128 | 256 | 256 |
| Position Weight/Initial Rate | 1.0/6.3 | 0.1/7.6 | 0.1/2.6 |
| Converter Layers/Conv. Width/Channels | 5/5/256 | 6/5/256 | 8/5/256 |
| Dropout Probability | 0.95 | 0.95 | 0.99 |
| Number of Speakers | 1 | 108 | 2484 |
| Speaker Embedding Dim. | — | 16 | 512 |
| ADAM Learning Rate | 0.001 | 0.0005 | 0.0005 |
| Anneal Rate/Anneal Interval | — | 0.98/30000 | 0.95/30000 |
| Batch Size | 16 | 16 | 16 |
| Max Gradient Norm | 100 | 100 | 50.0 |
| Gradient Clipping Max. Value | 5 | 5 | 5 |

2. Optimizing Deep Voice 3 Embodiments for Deployment

Running inference with a TensorFlow graph turns out to be prohibitively expensive, averaging approximately 1 QPS. The poor TensorFlow performance may be due to the overhead of running the graph evaluator over hundreds of nodes and hundreds of timesteps. Using a technology such as XLA with TensorFlow could speed up evaluation but is unlikely to match the performance of a hand-written kernel. Instead, custom GPU kernels were implemented for Deep Voice 3 embodiment inference. Due to the complexity of the model and the large number of output timesteps, launching individual kernels for different operations in the graph (e.g., convolutions, matrix multiplications, unary and binary operations, etc.) may be impractical; the overhead of launch a CUDA kernel is approximately 50 μs, which, when aggregated across all operations in the model and all output timesteps, limits throughput to approximately 10 QPS. Thus, a single kernel was implemented for the entire model, which avoids the overhead of launching many CUDA kernels. Finally, instead of batching computation in the kernel, the kernel embodiment herein operates on a single utterance and as many concurrent streams as there are Streaming Multiprocessors (SMs) on the GPU are launched. Every kernel may be launched with one block, so the GPU is expected to schedule one block per SM, allowing the ability to scale inference speed linearly with the number of SMs.

Figure 8A:
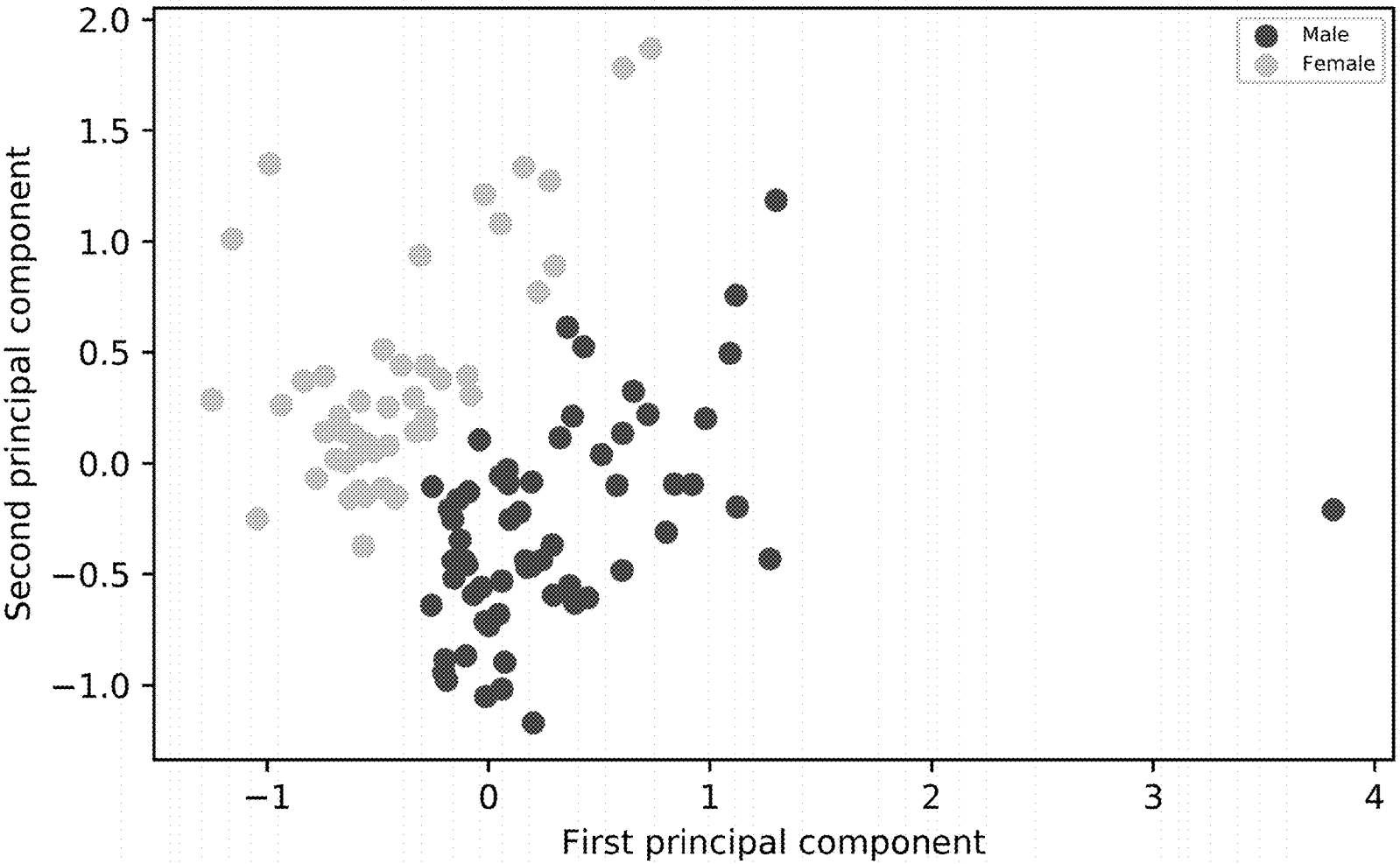
FIG. 8A shows the genders of the speakers in the space spanned by the first two principal component of the learned embedding for the VCTK dataset, according to embodiments of the present disclosure.
Figure 8B:
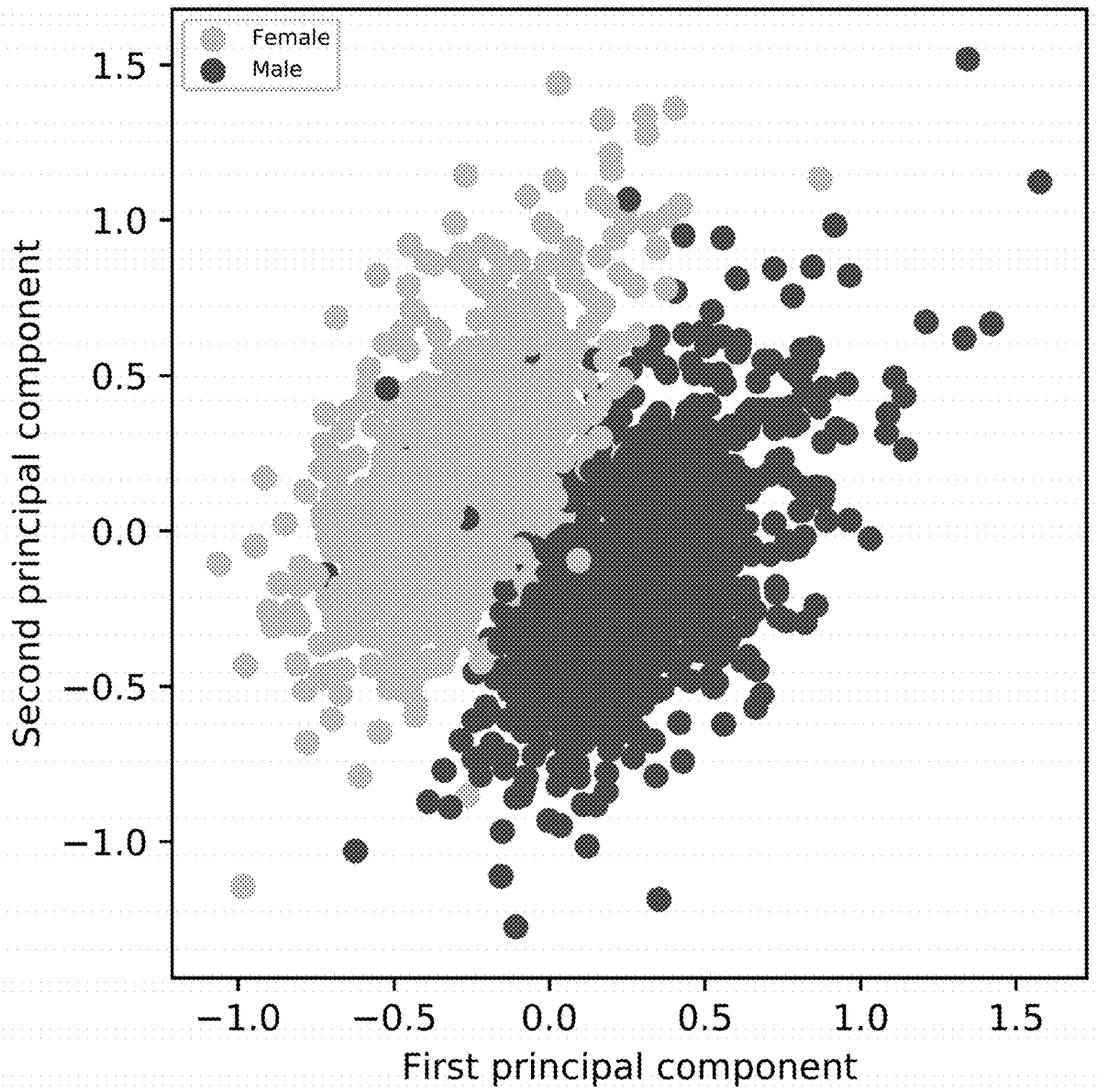
FIG. 8B shows the genders of the speakers in the space spanned by the first two principal component of the learned embedding for the LibriSpeech dataset, according to embodiments of the present disclosure.

On a single Nvidia Tesla P100 GPU by Nvidia Corporation based in Santa Clara, Calif. with 56 SMs, an inference 4. Latent Space of the Learned Embeddings Principal component analysis was applied to the learned speaker embeddings and the speakers were analyzed based on their ground truth genders. FIGS. 8A and 8B show the genders of the speakers in the space spanned by the first two principal components. A very clear separation between male and female genders was observed, suggesting the low-dimensional speaker embeddings constitute a meaningful latent space.

FIGS. 8A and 8B depict the first two principal components of the learned embeddings for (a) VCTK dataset (108 speakers) and (b) LibriSpeech dataset (2484 speakers), according to embodiments of the present disclosure.

5. 100-Sentence Test Set

The 100 sentences used to quantify the results in Table 1 are listed below (note that % symbol corresponds to pause):

1. A B C %.
2. X Y Z %.
3. HURRY %.
4. WAREHOUSE %.
5. REFERENDUM %.
6. IS IT FREE %?
7. JUSTIFIABLE %.
8. ENVIRONMENT %.
9. A DEBT RUNS %.
10. GRAVITATIONAL %.
11. CARDBOARD FILM %.
12. PERSON THINKING %.
13. PREPARED KILLER %.

14. AIRCRAFT TORTURE %.
15. ALLERGIC TROUSER %.
16. STRATEGIC CONDUCT %.
17. WORRYING LITERATURE %.
18. CHRISTMAS IS COMING %.
19. A PET DILEMMA THINKS %.
20. HOW WAS THE MATH TEST %?
21. GOOD TO THE LAST DROP %.
22. AN M B A AGENT LISTENS %.
23. A COMPROMISE DISAPPEARS %.
24. AN AXIS OF X Y OR Z FREEZES %.
25. SHE DID HER BEST TO HELP HIM %.
26. A BACKBONE CONTESTS THE CHAOS %.
27. TWO A GREATER THAN TWO N NINE %.
28. DON'T STEP ON THE BROKEN GLASS %.
29. A DAMNED FLIPS INTO THE PATIENT %.
30. A TRADE PURGES WITHIN THE B B C %.
31. I'D RATHER BE A BIRD THAN A FISH %.
32. I HEAR THAT NANCY IS VERY PRETTY %.
33. I WANT MORE DETAILED INFORMATION %.
34. PLEASE WAIT OUTSIDE OF THE HOUSE %.
35. N A S A EXPOSURE TUNES THE WAFFLE %.
36. A MIST DICTATES WITHIN THE MONSTER %.
37. A SKETCH ROPES THE MIDDLE CEREMONY %.
38. EVERY FAREWELL EXPLODES THE CAREER %.
39. SHE FOLDED HER HANDKERCHIEF NEATLY %.
40. AGAINST THE STEAM CHOOSES THE STUDIO %.
41. ROCK MUSIC APPROACHES AT HIGH VELOCITY %.
42. NINE ADAM BAYE STUDY ON THE TWO PIECES %.
43. AN UNFRIENDLY DECAY CONVEYS THE OUTCOME %.
44. ABSTRACTION IS OFTEN ONE FLOOR ABOVE YOU %.
45. A PLAYED LADY RANKS ANY PUBLICIZED PREVIEW %.
46. HE TOLD US A VERY EXCITING ADVENTURE STORY %.
47. ON AUGUST TWENTY EIGHTH % MARY PLAYS THE PIANO %.
48. INTO A CONTROLLER BEAMS A CONCRETE TERRORIST %.
49. I OFTEN SEE THE TIME ELEVEN ELEVEN ON CLOCKS %.
50. IT WAS GETTING DARK % AND WE WEREN'T THERE YET %.
51. AGAINST EVERY RHYME STARVES A CHORAL APPARATUS %.
52. EVERYONE WAS BUSY % SO I WENT TO THE MOVIE ALONE %.
53. I CHECKED TO MAKE SURE THAT HE WAS STILL ALIVE %.
54. A DOMINANT VEGETARIAN SHIES AWAY FROM THE G O P %.
55. JOE MADE THE SUGAR COOKIES % SUSAN DECORATED THEM %.
56. I WANT TO BUY A ONESIE % BUT KNOW IT WON'T SUIT ME %.
57. A FORMER OVERRIDE OF Q W E R T Y OUTSIDE THE POPE %.
58. F B I SAYS THAT C I A SAYS % I'LL STAY AWAY FROM IT %.
59. ANY CLIMBING DISH LISTENS TO A CUMBERSOME FORMULA %.
60. SHE WROTE HIM A LONG LETTER % BUT HE DIDN'T READ IT %.
61. DEAR % BEAUTY IS IN THE HEAT NOT PHYSICAL % I LOVE YOU %.
62. AN APPEAL ON JANUARY FIFTH DUPLICATES A SHARP QUEEN %.
63. A FAREWELL SOLOS ON MARCH TWENTY THIRD SHAKES NORTH %.
64. HE RAN OUT OF MONEY % SO HE HAD TO STOP PLAYING POKER %.
65. FOR EXAMPLE % A NEWSPAPER HAS ONLY REGIONAL DISTRIBUTION T %.
66. I CURRENTLY HAVE FOUR WINDOWS OPEN UP % AND I DON'T KNOW WHY %.
67. NEXT TO MY INDIRECT VOCAL DECLINES EVERY UNBEARABLE ACADEMIC %.
68. OPPOSITE HER SOUNDING BAG IS A M C'S CONFIGURED THOROUGHFARE %.
69. FROM APRIL EIGHTH TO THE PRESENT % I ONLY SMOKE FOUR CIGARETTES %.
70. I WILL NEVER BE THIS YOUNG AGAIN % EVER % OH DAMN % I JUST GOT OLDER %.
71. A GENEROUS CONTINUUM OF AMAZON DOT COM IS THE CONFLICTING WORKER %.
72. SHE ADVISED HIM TO COME BACK AT ONCE % THE WIFE LECTURES THE BLAST %.
73. A SONG CAN MAKE OR RUIN A PERSON'S DAY IF THEY LET IT GET TO THEM %.
74. SHE DID NOT CHEAT ON THE TEST % FOR IT WAS NOT THE RIGHT THING TO DO %.
75. HE SAID HE WAS NOT THERE YESTERDAY % HOWEVER % MANY PEOPLE SAW HIM THERE %.
76. SHOULD WE START CLASS NOW % OR SHOULD WE WAIT FOR EVERYONE TO GET HERE %?
77. IF PURPLE PEOPLE EATERS ARE REAL % WHERE DO THEY FIND PURPLE PEOPLE TO EAT %?
78. ON NOVEMBER EIGHTEENTH EIGHTEEN TWENTY ONE % A GLITTERING GEM IS NOT ENOUGH %.
79. A ROCKET FROM SPACE X INTERACTS WITH THE INDIVIDUAL BENEATH THE SOFT FLAW %.
80. MALLS ARE GREAT PLACES TO SHOP % I CAN FIND EVERYTHING I NEED UNDER ONE ROOF %.
81. I THINK I WILL BUY THE RED CAR % OR I WILL LEASE THE BLUE ONE % THE FAITH NESTS %.
82. ITALY IS MY FAVORITE COUNTRY % IN FACT % I PLAN TO SPEND TWO WEEKS THERE NEXT YEAR %.
83. I WOULD HAVE GOTTEN W W W DOT GOOGLE DOT COM % BUT MY ATTENDANCE WASN'T GOOD ENOUGH %.
84. NINETEEN TWENTY IS WHEN WE ARE UNIQUE TOGETHER UNTIL WE REALISE % WE ARE ALL THE SAME %.
85. MY MUM TRIES TO BE COOL BY SAYING H T T P COLON SLASH SLASH W W W B A I D U DOT COM %.
86. HE TURNED IN THE RESEARCH PAPER ON FRIDAY % OTHERWISE % HE EMAILED A S D F AT YAHOO DOT ORG %.
87. SHE WORKS TWO JOBS TO MAKE ENDS MEET % AT LEAST % THAT WAS HER REASON FOR NOT HAVING TIME TO JOIN US %.

88. A REMARKABLE WELL PROMOTES THE ALPHABET INTO THE ADJUSTED LUCK % THE DRESS DODGES ACROSS MY ASSAULT %.
89. A B C D E F G H I J K L M N O P Q R S T U V W X Y Z ONE TWO THREE FOUR FIVE SIX SEVEN EIGHT NINE TEN %.
90. ACROSS THE WASTE PERSISTS THE WRONG PACIFIER % THE WASHED PASSENGER PARADES UNDER THE INCORRECT COMPUTER %.
91. IF THE EASTER BUNNY AND THE TOOTH FAIRY HAD BABIES WOULD THEY TAKE YOUR TEETH AND LEAVE CHOCOLATE FOR YOU %?
92. SOMETIMES % ALL YOU NEED TO DO IS COMPLETELY MAKE AN ASS OF YOURSELF AND LAUGH IT OFF TO REALISE THAT LIFE ISN'T SO BAD AFTER ALL %.
93. SHE BORROWED THE BOOK FROM HIM MANY YEARS AGO AND HASN'T YET RETURNED IT % WHY WON'T THE DISTINGUISHING LOVE JUMP WITH THE JUVENILE %?
94. LAST FRIDAY IN THREE WEEK'S TIME I SAW A SPOTTED STRIPED BLUE WORM SHAKE HANDS WITH A LEGLESS LIZARD % THE LAKE IS A LONG WAY FROM HERE %.
95. I WAS VERY PROUD OF MY NICKNAME THROUGHOUT HIGH SCHOOL BUT TODAY % I COULDN'T BE ANY DIFFERENT TO WHAT MY NICKNAME WAS % THE METAL LUSTS % THE RANGING CAPTAIN CHARTERS THE LINK %.
96. I AM HAPPY TO TAKE YOUR DONATION % ANY AMOUNT WILL BE GREATLY APPRECIATED % THE WAVES WERE CRASHING ON THE SHORE % IT WAS A LOVELY SIGHT % THE PARADOX STICKS THIS BOWL ON TOP OF A SPONTANEOUS TEA %.
97. A PURPLE PIG AND A GREEN DONKEY FLEW A KITE IN THE MIDDLE OF THE NIGHT AND ENDED UP SUNBURNT % THE CONTAINED ERROR POSES AS A LOGICAL TARGET % THE DIVORCE ATTACKS NEAR A MISSING DOOM % THE OPERA FINES THE DAILY EXAMINER INTO A MURDERER %.
98. AS THE MOST FAMOUS SINGER-SONGWRITER % JAY CHOU GAVE A PERFECT PERFORMANCE IN BEIJING ON MAY TWENTY FOURTH % TWENTY FIFTH % AND TWENTY SIXTH TWENTY THREE ALL THE FANS THOUGHT HIGHLY OF HIM AND TOOK PRIDE IN HIM ALL THE TICKETS WERE SOLD OUT %.
99. IF YOU LIKE TUNA AND TOMATO SAUCE % TRY COMBINING THE TWO % IT'S REALLY NOT AS BAD AS IT SOUNDS % THE BODY MAY PERHAPS COMPENSATES FOR THE LOSS OF A TRUE METAPHYSICS % THE CLOCK WITHIN THIS BLOG AND THE CLOCK ON MY LAPTOP ARE ONE HOUR DIFFERENT FROM EACH OTHER %.
100. SOMEONE I KNOW RECENTLY COMBINED MAPLE SYRUP AND BUTTERED POPCORN THINKING IT WOULD TASTE LIKE CARAMEL POPCORN % IT DIDN'T AND THEY DON'T RECOMMEND ANYONE ELSE DO IT EITHER % THE GENTLEMAN MARCHES AROUND THE PRINCIPAL % THE DIVORCE ATTACKS NEAR A MISSING DOOM % THE COLOR MISPRINTS A CIRCULAR WORRY ACROSS THE CONTROVERSY %.

H. CITED DOCUMENTS

Each document listed below or referenced anywhere herein is incorporated by reference herein in its entirety.

Yannis Agiomyrgiannakis. Vocaine the Vocoder and Applications in Speech Synthesis. In ICASSP, 2015.

Chris Bagwell. Sox-sound exchange. https://sourceforge.net/p/sox/code/ci/master/tree/, 2017.

Jonas Gehring, Michael Auli, David Grangier, Denis Yarats, and Yann Dauphin. Convolutional Sequence to Sequence Learning. In ICML, 2017.

Daniel Griffin and Jae Lim. Signal Estimation From Modified Short-Time Fourier Transform. *IEEE Transactions on Acoustics, Speech, and Signal Processing,* 1984.

Hideki Kawahara, Ikuyo Masuda-Katsuse, and Alain De Cheveigne. Restructuring Speech Representations Using A Pitch-Adaptive Time-Frequency Smoothing and An Instantaneous-Frequency-Based F0 Extraction: Possible Role Of A Repetitive Structure In Sounds. *Speech communication,* 1999.

Soroush Mehri, Kundan Kumar, Ishaan Gulrajani, Rithesh Kumar, Shubham Jain, Jose Sotelo, Aaron Courville, and Yoshua Bengio. Sample RNN: An Unconditional End-To-End Neural Audio Generation Model. In *ICLR,* 2017.

Masanori Morise, Fumiya Yokomori, and Kenji Ozawa. WORLD: A vocoder-based high-quality speech synthesis system for real-time applications. *IEICE Transactions on Information and Systems,* 2016.

Robert Ochshorn and Max Hawkins. Gentle. https://github.com/lowerquality/gentle, 2017.

Aaron van den Oord, Sander Dieleman, Heiga Zen, Karen Simonyan, Oriol Vinyals, Alex Graves, Nal Kalchbrenner, Andrew Senior, and Koray Kavukcuoglu. WaveNet: A generative model for raw audio. *arXiv:* 1609.03499, 2016.

Vassil Panayotov, Guoguo Chen, Daniel Povey, and Sanjeev Khudanpur. LibriSpeech: An ASR corpus based on public domain audio books. In *Acoustics, Speech and Signal Processing* (*ICASSP*), 2015 *IEEE International Conference on*, pp. 5206-5210. IEEE, 2015. The LibriSpeech dataset is available at http://www.openslr.org/12/.

Colin Raffel, Thang Luong, Peter J Liu, Ron J Weiss, and Douglas Eck. Online and Linear-Time Attention by Enforcing Monotonic Alignments. In *ICML,* 2017.

Flavio Ribeiro, Dinei Florencio, Cha Zhang, and Michael Seltzer. CrowdMOS: An approach for crowdsourcing mean opinion score studies. In *IEEE ICASSP,* 2011.

Jose Sotelo, Soroush Mehri, Kundan Kumar, Joao Felipe Santos, Kyle Kastner, Aaron Courville, and Yoshua Bengio. Char2Wav: End-to-End Speech Synthesis. In *ICLR workshop,* 2017.

Yaniv Taigman, Lior Wolf, Adam Polyak, and Eliya Nachmani. Voice synthesis for in-the-wild speakers via a phonological loop. *arXiv:* 1707.06588, 2017.

YuxuanWang, RJ Skerry-Ryan, Daisy Stanton, YonghuiWu, RonWeiss, Navdeep Jaitly, Zongheng Yang, Ying Xiao, Zhifeng Chen, Samy Bengio, Quoc Le, Yannis Agiomyrgiannakis, Rob Clark, and Rif A. Saurous. Tacotron: Towards End-To-End Speech Synthesis. In *Interspeech,* 2017.

Junichi Yamagishi, Bela Usabaev, Simon King, Oliver Watts, John Dines, Jilei Tian, Yong Guan, Rile Hu, Keiichiro Oura, Yi-JianWu, et al. Thousands of Voices for HMM-Based Speech Synthesis—Analysis and Application of TTSSystems Built on Various ASR Corpora. *IEEE Transactions on Audio, Speech, and Language Processing,* 2010.

What is claimed is:

1. A text-to-speech system comprising:

one or more processors; and a non-transitory computer-readable medium or media comprising one or more sequences of instructions which, when executed by at least one of the one or more processors, causes steps to be performed comprising:

converting textual features of input text into attention key representations and attention value representations using an encoder comprising:

an embedding model, which converts an input text into text embedding representations, a series of one or more convolution blocks that receive projections of the text embedding representations and process them through the series of one or more convolution blocks to extract time-dependent text information from the input text;

a projection layer that generates projections of the extracted time-dependent text information, which are used to form attention key representations; and a value representation calculator which computes attention value representations from the attention key representations and the text embeddings representations; and autoregressively generating low-dimensional audio representations of the input text using an attention-based decoder comprising:

a prenet block that receives input data representing audio frames and comprises one or more fully-connected layers to preprocess the input data;

a series of one or more decoder blocks, each decoder block comprising a convolution block and an attention block, in which a convolution block generates a query and the attention block computes a context representation as a weighted average of at least a portion of the attention value representations and attention weights computed using the query from the convolution block and at least a portion of the attention key representations; and a postnet block comprising a fully-connected layer, which receives an output from the series of one or more decoder blocks and outputs a next set of low-dimensional audio representations.

2. The text-to-speech system of claim 1 wherein the attention-based decoder further comprises:

a final frame prediction block that also receives the output from the series of one or more decoder blocks and outputs an indicator whether a last audio frame has been synthesized.

3. The text-to-speech system of claim 1 wherein the attention-based decoder further comprises:

forcing monotonicity of the attention weights by computing a softmax over a fixed time window that starts at a last attended-to time frame and includes one or more time frames forward in time from the last attended-to time frame.

4. The text-to-speech system of claim 1 further comprising:

a convertor that converts a final set of low-dimensional audio representation frames to the signal representing synthesized speech of the input text.

5. The text-to-speech system of claim 1 further comprising inputting a speaker indicator that represents one or more speaker audio characteristics into both the encoder and the attention-based decoder to facilitate the synthesized speech having the speaker audio characteristics.

6. The text-to-speech system of claim 1 wherein the attention block further comprises adding a first positional encoding to the attention key representations and a second positional encoding to the query.

7. The text-to-speech system of claim 1 wherein the convolution block comprises a one-dimensional convolution filter, a gated-linear unit, a residual connection to its input, and a scaling factor.

8. A computer-implemented method for training a convolutional sequence learning text-to-speech (TTS) system to synthesize speech from an input text, comprising:

converting the input text into a set of trainable embedding representations using an embedding model;

generating, via an encoder comprising one or more convolutional blocks, a set of attention key representations that correspond to time-dependent text information extracted by the encoder from data obtained from the set of trainable embedding representations;

generating a set of attention value representations corresponding to the set of attention key representations using the set of trainable embedding representations and the set of attention key representations; and generating a set of vocoder features, which are usable with a vocoder to produce a signal representing synthesized speech, from a context representation generated by an attention-based decoder, which comprises at least one decoder block comprising a causal convolution block and an attention block and which uses the set of attention key representations, the set of attention value representations, and features from ground truth audio that corresponds to the input text to, for each time frame:

generate a query using the causal convolution block and data obtained from at least a portion of a representation of prior audio frames; and compute, via the attention block, the context representation as a weighted average of at least a portion of the set of attention value representations and attention weights computed using the query from the casual causal convolution block and at least a portion of the set of attention key representations.

9. The computer-implemented method of claim 8 wherein the embedding model is a mixed character-and-phoneme model in which an in-dictionary word is converted to its corresponding phoneme representation using a word-to-phoneme dictionary and wherein an out-of-dictionary word is input as characters and the embedding model implicitly learns a conversion to phonemes.

10. The computer-implemented method of claim 8 further comprising providing a trainable speaker embedding that represents one or more speaker audio characteristics, the trainable speaker embedding being input to both the encoder and the decoder to facilitate the synthesized speech having the speaker audio characteristics.

11. The computer-implemented method of claim 8 wherein the set of vocoder features are input to a converter that converts the vocoder features to the signal representing synthesized speech.

12. The computer-implemented method of claim 8 wherein the encoder, the decoder, and the converter comprise a fully-convolutional sequence-to-sequence architecture.

13. A computer-implemented method for synthesizing speech from an input text, the method comprising:

encoding the input text into a set of key representations and a set of value representations using a trained encoder comprising one or more convolution layers;

decoding the set of key representations and the set of value representations into a set of low-dimensional audio representation frames using a trained attention-based decoder, the trained attention-based decoder comprising at least one decoder block comprising a casual causal convolution block and an attention block, in which, for each time frame:

the causal convolution block uses at least a portion of prior low-dimensional audio representation frames to generate a query; and the attention block computes a context representation as a weighted average of at least a portion of the set of value representations and attention weights computed using the query from the causal convolution block and at least a portion of the set of key representations; and using the context representation to generate a final set of low-dimensional audio representation frames to be used by a vocoder to output a signal representing synthesized speech of the input text.

14. The computer-implemented method of claim 13 further comprising forcing monotonicity of the attention weights during inference.

15. The computer-implemented method of claim 14 wherein the step of forcing monotonicity of the attention weights during inference comprises:

computing a softmax over a fixed time window that starts at a last attended-to audio frame and includes one or more audio frames forward in time from the last attended-to audio frame.

16. The computer-implemented method of claim 13 wherein the trained encoder comprises a mixed character-and-phoneme model in which an in-dictionary word in the input text is converted to its corresponding phoneme representation using a word-to-phoneme dictionary and wherein an out-of-dictionary word in the input text converted to phonemes by the mixed character-and-phoneme model as a result of training.

17. The computer-implemented method of claim 13 further comprising inputting a speaker indicator that represents one or more speaker audio characteristics into both the trained encoder and the trained attention-based decoder to facilitate the synthesized speech having the speaker audio characteristics.

18. The computer-implemented method of claim 13 wherein the final set of low-dimensional audio representation frames are input to a converter that converts the final set of low-dimensional audio representation frames to the signal representing synthesized speech of the input text.

19. The computer-implemented method of claim 18 wherein the trained encoder, the trained attention-based decoder, and the converter form a fully-convolutional sequence-to-sequence architecture.

20. The computer-implemented method of claim 13 wherein the attention block comprises adding a first positional encoding to the key representations and a second positional encoding to the query.

* * * * *